US010470503B2

(12) United States Patent
Danos et al.

(10) Patent No.: US 10,470,503 B2
(45) Date of Patent: Nov. 12, 2019

(54) CLOTHING ARTICLE WITH INTEGRATED THERMAL REGULATION SYSTEM

(71) Applicants: Jeffrey A. Danos, Park City, UT (US); Jack A. Danos, Park City, UT (US)

(72) Inventors: Jeffrey A. Danos, Park City, UT (US); Jack A. Danos, Park City, UT (US)

( * ) Notice: Subject to any disclaimer, the term of this patent is extended or adjusted under 35 U.S.C. 154(b) by 34 days.

(21) Appl. No.: 15/886,882

(22) Filed: Feb. 2, 2018

(65) Prior Publication Data

US 2018/0213854 A1 Aug. 2, 2018

Related U.S. Application Data

(60) Provisional application No. 62/453,583, filed on Feb. 2, 2017, provisional application No. 62/470,111, filed on Mar. 10, 2017.

(51) Int. Cl.

| | |
|---|---|
| ***A41D 13/005*** | (2006.01) |
| ***A43B 3/00*** | (2006.01) |
| ***A43B 7/34*** | (2006.01) |
| ***A43B 7/02*** | (2006.01) |

(52) U.S. Cl.

CPC ..... *A41D 13/0051* (2013.01); *A43B 3/0005* (2013.01); *A43B 7/02* (2013.01); *A43B 7/34* (2013.01); *A41D 2400/12* (2013.01)

(58) Field of Classification Search

CPC .. A41D 13/0051; A41D 2400/12; A43B 7/02; A43B 7/34; A43B 3/0005; A43B 17/026; A61F 2007/0045

See application file for complete search history.

(56) References Cited

U.S. PATENT DOCUMENTS

| | | | | |
|---|---|---|---|---|
| 3,869,594 | A | 3/1975 | Shively | |
| 4,123,855 | A | 11/1978 | Thedford | |
| 4,800,867 | A | 1/1989 | Owens | |
| 4,997,032 | A | 3/1991 | Danielson et al. | |
| 5,035,003 | A | 7/1991 | Rinehart | |
| 5,375,430 | A | 12/1994 | Siegel | |
| 5,953,834 | A * | 9/1999 | Clodic | A41D 13/005 36/2.6 |
| 6,055,670 | A | 5/2000 | Parker | |
| 6,074,414 | A * | 6/2000 | Haas | A61F 7/02 607/108 |
| 9,572,393 | B2 * | 2/2017 | Krupenkin | A43B 7/02 |
| 2001/0023366 | A1 | 9/2001 | Usui | |

(Continued)

*Primary Examiner* — Emmanuel E Duke

(74) *Attorney, Agent, or Firm* — Asgaard Patent Services, LLC; F. Wayne Thompson, Jr.

(57) ABSTRACT

Implementations of a clothing article with an integrated thermal regulation system are provided. In some implementation, a clothing article with an integrated thermal regulation system may be configured to heat a portion of a wearer's body by transferring heat from a warmer first region of the body (e.g., the calf portion of the leg or wrist portion of the arm) to a cooler second region (e.g., the plantar side of the toes or the dorsal side of the fingers). The transfer of heat is facilitated by a thermally conductive fluid that flows between a first thermal transfer bag in heat exchange contact with the warmer first region of the wearer's body and a second thermal transfer bag that is in heat exchange contact with the cooler second region, the thermal transfer bags being held in position by the clothing article into which they have been integrated.

8 Claims, 16 Drawing Sheets

(56) References Cited

U.S. PATENT DOCUMENTS

| | | | | |
|---|---|---|---|---|
| 2003/0145367 | A1 | 8/2003 | Isom et al. | |
| 2005/0055842 | A1 | 3/2005 | Szczesuil et al. | |
| 2006/0058858 | A1 | 3/2006 | Smith | |
| 2007/0267398 | A1 | 11/2007 | McCoy et al. | |
| 2007/0278201 | A1* | 12/2007 | Jones | A41B 11/00 219/211 |
| 2010/0282433 | A1 | 11/2010 | Blackford | |
| 2010/0324611 | A1 | 12/2010 | Deming et al. | |
| 2012/0053661 | A1* | 3/2012 | Hooper | A61F 7/02 607/104 |
| 2013/0019503 | A1* | 1/2013 | Vogt | A43B 3/0005 36/103 |
| 2014/0182164 | A1* | 7/2014 | Krupenkin | A43B 7/02 36/2.6 |
| 2016/0143388 | A1* | 5/2016 | Stender | A43B 7/02 165/10 |
| 2016/0262924 | A1 | 9/2016 | Abreu | |
| 2016/0334813 | A1* | 11/2016 | Park | G05D 23/19 |

* cited by examiner

CLOTHING ARTICLE WITH INTEGRATED THERMAL REGULATION SYSTEM

CROSS REFERENCE TO RELATED APPLICATION

This application claims the benefit of U.S. Provisional Application Ser. No. 62/453,583, which was filed on Feb. 2, 2017, and U.S. Provisional Application Ser. No. 62/470,111, which was filed on Mar. 10, 2017, the entireties of both applications are incorporated herein by reference in their entirety.

TECHNICAL FIELD

This disclosure relates to implementations of a clothing article with an integrated thermal regulation system. In particular, the present invention is directed to clothing articles such as socks, gloves, mittens, and/or shoes that have an integrated thermal regulation system.

BACKGROUND

Heated garments, such as gloves and boots, are well known in the prior art. Such garments are often used by those who work in cold environments or engage in cold-weather sports such as skiing. Heated garments can minimize or prevent cold-related discomfort, in particular numbness that can result from vasoconstriction in the fingers.

The prior art shows that a variety of heat sources have been incorporated into heated garments. Often, the heat source utilizes either battery power or chemical energy. Battery powered heated garments include batteries and resistance heating circuitry. The resistance heating circuitry can fail due to circuit wiring breaking during extended use. Also, due to the resistance heating circuitry, battery powered heating sources are difficult to launder. Chemical energy systems use chemical packs that heat when exposed to oxygen. These chemical energy powered heat packs do not perform well where airflow is restricted, such as in insulated gloves/mittens or footwear applications. Further, these heat packs are single use items that must be replaced after each use, thereby increasing costs.

In addition, there have been various attempts to use fluid(s) for the delivery of heat or cold to portions of the body. For example. U.S. Pat. No. 6,074,414 discloses a thermal applicator that is applied directly to the body of a patient to modify its temperature. The thermal applicator comprises a heat pipe and an ice pack (or other thermal material or apparatus). Another example may be found in U.S. Pat. No. 4,800,867 which discloses a foot comforter apparatus adapted to cool or heat the foot. The foot comforter apparatus is configured to facilitate one direction flow of the fluid through the system and relies on check valves to resist multi-directional flow of the fluid.

Accordingly, it can be seen that needs exist for a clothing article having an integrated thermal regulation system disclosed herein. It is to the provision of a clothing article with an integrated thermal regulation system to address these needs, and others, that the present invention is primarily directed.

SUMMARY OF THE INVENTION

Implementations of a clothing article with an integrated thermal regulation system are provided. In some implementations, a clothing article with an integrated thermal regulation system may be configured to heat a portion of a wearer's body by transferring heat from a warmer first region of the body (e.g., the calf portion of the leg or wrist portion of the arm) to a cooler second region (e.g., the plantar side of the toes or the dorsal side of the fingers). The transfer of heat is facilitated by a thermally conductive liquid (e.g., water) that flows between two or more thermal transfer bags that are in fluid communication with each other.

In some implementations, a first thermal transfer bag of a thermal regulation system may be in heat exchange contact with a relatively warm first region of the wearer's body (e.g., the calf portion of the leg or wrist portion of the arm) and at least one other thermal transfer bag may be in heat exchange contact with a cooler second region of the wearer's body (e.g., the plantar side of the toes or the dorsal side of the fingers). In this way, the thermally conductive liquid present in the first thermal transfer bag may be heated by the wearer's body and circulated to the other thermal transfer bag(s) in fluid communication therewith. Thus, heat may be transferred from the warmer first region of the wearer's body to the cooler second region by the thermally conductive liquid contained within the thermal regulation system.

In some implementations, a thermal regulation system may comprise a first thermal transfer bag connected to a second thermal transfer bag by at least one tube, the at least one tube places the first thermal transfer bag into fluid communication with the second thermal transfer bag. In some implementations, the first and second thermal transfer bags may be configured to contain, and transfer therebetween via the at least one tube, a thermally conductive liquid (e.g., water).

In some implementations, a thermal regulation system may be configured to facilitate a bi-directional flow of the thermally conductive liquid therein.

In some implementations, one or more baffles configured and positioned to effect the distribution and flow of the thermally conductive liquid contained within a thermal regulation system may be incorporated into one or more of the thermal transfer bags thereof. In some implementations, each baffle may be configured to restrict the expansion of a thermal transfer bag.

In some implementations, the thermal regulation system may be integrated into a sock. In some implementations, the sock may be used to position the first thermal transfer bag in heat exchange contact with the calf portion of the leg and the second thermal transfer bag in heat exchange contact with the plantar side of the toes, or other portion of the foot. In some implementations, the first thermal transfer bag and/or the second thermal transfer bag may be configured to conform to the region of the wearer's body that it is in heat exchange contact with.

In some implementations, the first thermal transfer bag may be configured so that gravity allows at least a portion of the thermally conductive liquid to flow therefrom, through the at least one tube, and into the second thermal transfer bag. In this way, heat may be transferred from a warmer first region of the wearer's body (e.g., the calf portion of the leg) to a cooler second region of the wearer's body (e.g., the plantar side of the toes) by the thermally conductive liquid.

In some implementations, the second thermal transfer bag may be configured so that the ambulation, or movement, of the wearer (e.g., stepping on the thermal transfer bag) causes at least a portion of the thermally conductive liquid to flow therefrom, through the at least one tube, and into the first thermal transfer bag. In this way, at least a portion of the thermally conductive liquid may be transferred from the second thermal transfer bag to the first thermal transfer bag to be heated therein.

In some implementations, the thermal regulation system may further comprise a third thermal transfer bag that is in fluid communication with, at least, the first thermal transfer bag. In some implementations, the sock may be used to position the third thermal transfer bag in heat exchange contact with the dorsum side of the toes.

In some implementations, the third thermal transfer bag may be configured so that the ambulation, or movement, of the wearer (e.g., walking) causes at least a portion of the thermally conductive liquid to flow therefrom, through a connecting tube, and into the first thermal transfer bag. In this way, at least a portion of the thermally conductive liquid may be transferred from the third thermal transfer bag to the first thermal transfer bag to be heated therein.

In some implementations, a conduit may be used to place a second and a third thermal transfer bag into fluid communication and/or to connect a second thermal transfer bag to a tube extending from a first thermal transfer bag. In some implementations, the conduit may extend from a lateral side of a thermal transfer bag positioned underneath the foot of the wearer, alongside a lateral portion of the foot, thereby minimizing, or eliminating, any discomfort the conduit may cause the wearer.

In some implementations, a spacer may be positioned within and extend the length, or the approximate length, of a conduit. In some implementations, the spacer may be configured and/or positioned to preserve the opening extending through the conduit, thereby allowing the thermally conductive liquid to flow therethrough.

In some implementations, a thermal regulation system comprising a first thermal transfer bag that is in fluid communication with a second and a third thermal transfer bag may be integrated into a mitten. In this way, the thermal regulation system may be used to warm the dorsal side of the fingers.

In some implementations, the mitten with an integrated thermal regulation system may be configured so that the wearer can circulate at least a portion of the thermally conductive liquid contained therein between the first thermal transfer bag and the second and third thermal transfer bags. In some implementations, the mitten may be configured to position the first thermal transfer bag in heat exchange contact with the wrist portion of the arm, the second thermal transfer bag in heat exchange contact with the dorsal side of the index, middle, ring, and little fingers, and the third thermal transfer bag in heat exchange contact with the dorsal side of the thumb finger.

In some implementations, a thermal regulation system comprising a first thermal transfer bag that is in fluid communication with a second, a third, a fourth, a fifth, and a sixth thermal transfer bag may be integrated into a glove. In this way, the thermal regulation system may be used to warm the dorsal side of each finger individually.

In some implementations, the glove with an integrated thermal regulation system may be configured so that the wearer can circulate at least a portion of the thermally conductive liquid between the first thermal transfer bag and the other thermal transfer bags positioned within the finger sheaths of the glove. In some implementations, the glove may be used to position the first thermal transfer bag in heat exchange contact with the wrist portion of the arm, the second thermal transfer bag in heat exchange contact with the dorsal side of the index finger, the third thermal transfer bag in heat exchange contact with the dorsal side of the middle finger, the fourth thermal transfer bag in heat exchange contact with the dorsal side of the ring finger, the fifth thermal transfer bag in heat exchange contact with the dorsal side of the little finger, and the sixth thermal transfer bag in heat exchange contact with the dorsal side of the thumb finger.

In some implementations, a thermal regulation system comprising a first thermal transfer bag that is in fluid communication with a second thermal transfer bag may be integrated into a shoe. In this way, the thermal regulation system may be configured to cool a region of the wearer's body using the heat transfer properties thereof.

In some implementations, the shoe with an integrated thermal regulation system may be configured to circulate at least a portion of the thermally conductive liquid between the first thermal transfer bag and the second thermal transfer bag. In some implementations, the first thermal transfer bag may be positioned on the exterior of the shoe and the second thermal transfer bag positioned in heat exchange contact with the plantar side of the toes, or other portion of the foot. In this way, the first thermal transfer bag is positioned to lose heat to the surrounding environment and thereby allow the thermally conductive fluid within the system to cool the portion(s) of the wearer's body that the second thermal transfer bag is in heat exchange contact with.

These and other aspects, features, and advantages of the invention will be understood with reference to the drawing figures and detailed description herein, and will be realized by means of the various elements and combinations particularly pointed out in the appended claims. It is to be understood that both the foregoing general description and the following brief description of the drawings and the detailed description of the invention are exemplary and explanatory of preferred implementations of the invention, and are not restrictive of the invention, as claimed.

BRIEF DESCRIPTION OF THE DRAWINGS

FIG. 1A-1D illustrate an example implementation of a thermal regulation system; wherein FIGS. 1A and 1C illustrate the thermal regulation system integrated into a sock.

FIGS. 2A and 2B illustrate another example implementation of a thermal regulation system; wherein FIG. 2A illustrates the thermal regulation system integrated into a sock.

FIGS. 3A and 3B illustrate yet another example implementation of a thermal regulation system; wherein FIG. 3A illustrates the thermal regulation system integrated into a mitten.

FIGS. 4A and 4B illustrate still yet another example implementation of a thermal regulation system; wherein FIG. 4A illustrates the thermal regulation system integrated into a glove.

FIGS. 5A and 5B illustrate yet another example implementation of a thermal regulation system; wherein FIG. 5A illustrates the thermal regulation system integrated into a shoe.

FIG. 6A-6D illustrate still yet another example implementation of a thermal regulation system; wherein FIGS. 6A and 6C illustrate the thermal regulation system integrated into a sock.

FIGS. 7A and 7B illustrate yet another example implementation of a thermal regulation system; wherein FIG. 7A illustrates the thermal regulation system integrated into a mitten.

FIGS. 8A and 8B illustrate still yet another example implementation of a thermal regulation system; wherein FIG. 8A illustrates the thermal regulation system integrated into a mitten.

FIGS. 9A-9D illustrate yet another example implementation of a thermal regulation system; wherein FIGS. 9A and 9C illustrate the thermal regulation system integrated into a sock.

FIGS. 10A-10D illustrate still yet another example implementation of a thermal regulation system; wherein FIGS. 10A and 10C illustrate the thermal regulation system integrated into a sock.

FIGS. 11A-11D illustrate yet another example implementation of a thermal regulation system; wherein FIGS. 11A and 11C illustrate the thermal regulation system integrated into a sock.

DETAILED DESCRIPTION

FIGS. 1A-1D illustrate an example clothing article (i.e., a sock 105) with an integrated thermal regulation system 100. In some implementations, the integrated thermal regulation system 100 may be configured to heat a portion of a wearer's body (e.g., the foot, hand, etc.) without employing an outside source of energy.

Figure 1B:
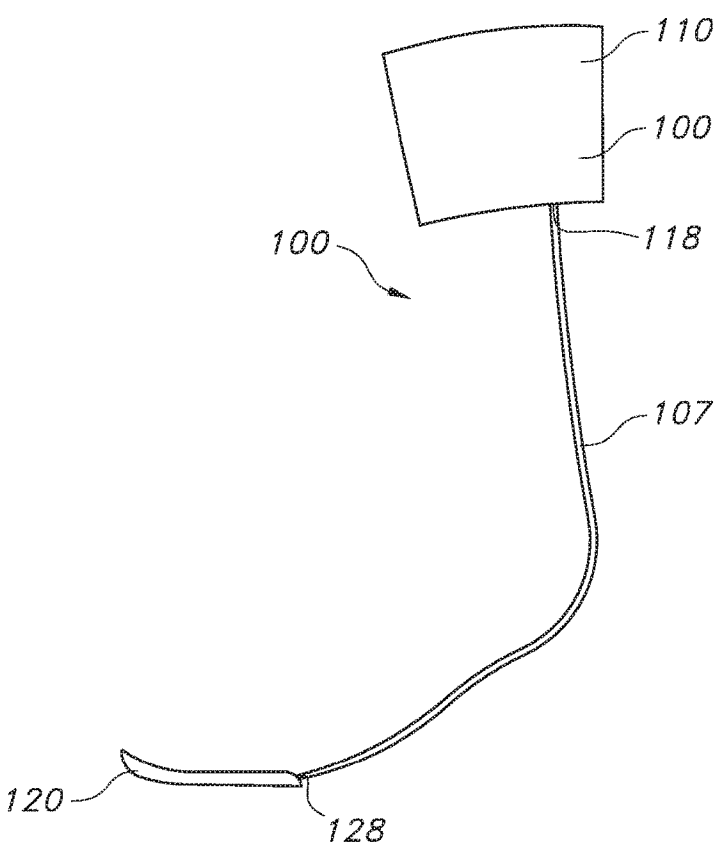

As shown in FIG. 1B, in some implementations, a thermal regulation system 100 may comprise a first thermal transfer bag 110 connected to a second thermal transfer bag 120 by at least one tube 107. In some implementations, the at least one tube 107 places the first thermal transfer bag 110 into fluid communication with the second thermal transfer bag 120. In some implementations, the first and second thermal transfer bags 110, 120 may be configured to contain, and transfer therebetween via the at least one tube 107, a thermally conductive liquid (e.g., water). In some implementations, the thermal regulation system 100 may be configured to facilitate a bi-directional flow of the thermally conductive liquid therein.

In some implementations, the thermal regulation system 100 may be used by positioning the first thermal transfer bag 110 in heat exchange contact with a relatively warm first region of the wearer's body (e.g., the calf portion of the leg or the wrist portion of the arm) and the second thermal transfer bag 120 in heat exchange contact with a second region of the wearer's body (e.g., the plantar side of the toes or the dorsal side of the fingers). In this way, heat may be transferred from the relatively warm first region to the second region of the wearer's body by the thermally conductive liquid contained within the thermal regulation system 100.

Figure 1A:
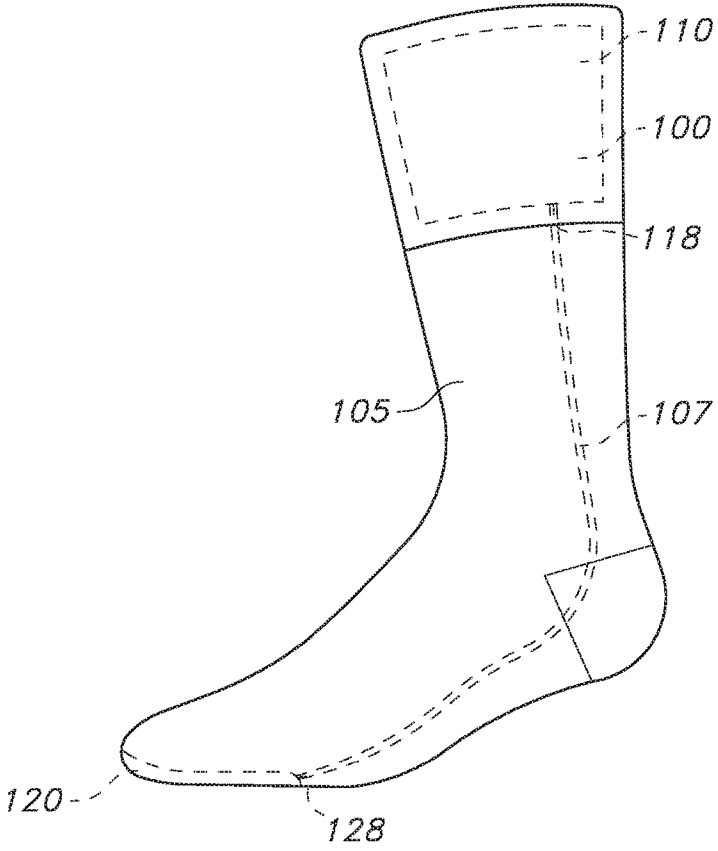
Figure 1D:
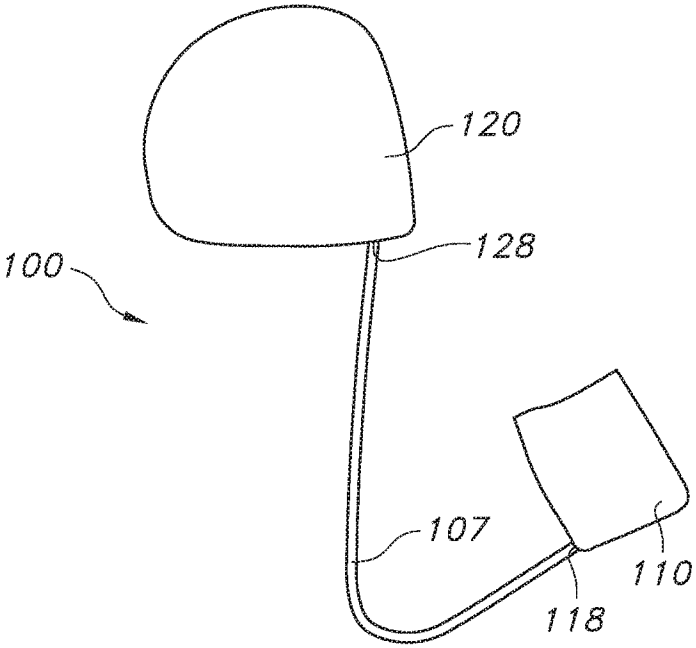
Figure 1C:
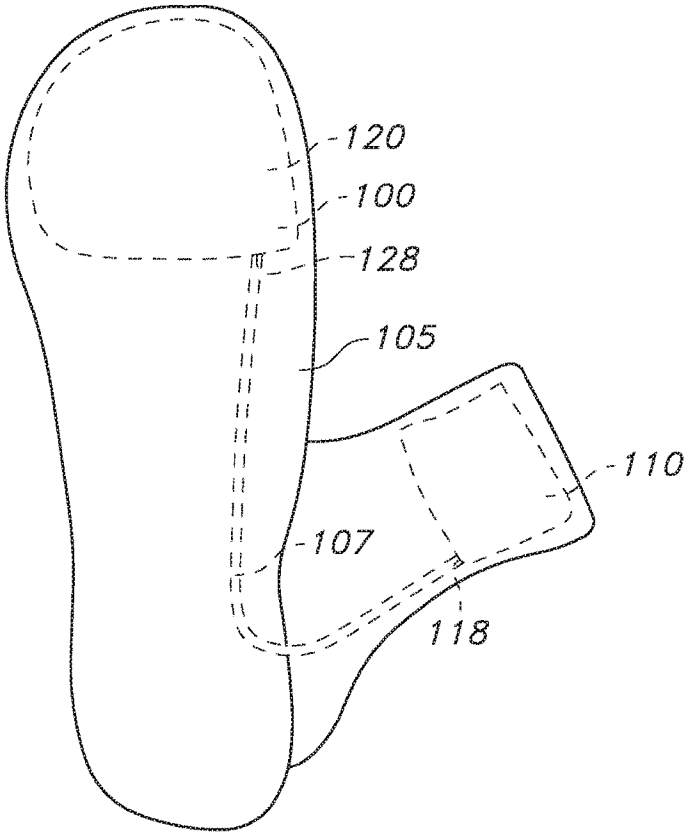

As shown in FIGS. 1A and 1C, in some implementations, the thermal regulation system 100 may be integrated into a sock 105. In some implementations, the sock 105 with an integrated thermal regulation system 100 may be configured to assist with circulating at least a portion of the thermally conductive liquid between the first thermal transfer bag 110 and the second thermal transfer bag 120. In some implementations, the sock 105 may be used to position the first thermal transfer bag 110 in heat exchange contact with the calf portion, or other portion (e.g., the ankle), of the leg and the second thermal transfer bag 120 in heat exchange contact with the plantar side of the toes, or other portion of the foot (see, e.g., FIG. 1A).

In some implementations, the leg portion of the sock 105 may be configured to both support the weight of the first thermal transfer bag 110 and hold it in position on the wearer's leg. In some implementations, an elastic band may be used to press the leg portion of the sock 105 and/or the thermal transfer bag 110 against the leg of the wearer, thereby securing the first thermal transfer bag 110 in position. In some implementations, the elastic band may be positioned adjacent the opening into the leg portion of the sock 105. One of ordinary skill in the art, having the benefit of the present disclosure, would know how to construct a sock 105 capable of supporting the weight of a thermal transfer bag while holding it in heat exchange contact with the desired portion of a wearer's body.

In some implementations, the thermal regulation system 100 may be configured to warm the plantar side and/or the dorsum side of the toes (not shown). For example, the second thermal transfer bag could be configured to wrap about the toes, or other portion of the foot.

As shown in FIGS. 1A and 1C, in some implementations, the first thermal transfer bag 110 may be configured so that gravity allows at least a portion of the thermally conductive liquid to flow therefrom, through the at least one tube 107, and into the second thermal transfer bag 120. In this way, heat may be transferred from a relatively warm first region of the wearer's body (e.g., the calf portion of the leg) to a second region of the wearer's body (e.g., the plantar side of the toes) by the thermally conductive liquid.

In some implementations, an elastic band or other compression strap may be positioned about the exterior of the first thermal transfer bag 110 and/or the leg to which it is in heat exchange contact with (not shown). In this way, the compression strap may be used to force at least a portion of the thermally conductive liquid from the first thermal transfer bag 110, through the at least one tube 107, and into the second thermal transfer bag 120. In some implementations, the thermal regulation system 100 may not be used in conjunction with a compression strap.

In some implementations, the first thermal transfer bag 110 may be configured so that the at least one tube 107 extends from a top side thereof when positioned in heat exchange contact with the wearer's body (not shown). In some implementations, a compression strap may be used to force at least a portion of the thermally conductive liquid from the first thermal transfer bag 110, up into and through the at least one tube 107, and into the second thermal transfer bag 120. In this way, the at least one tube 107 may act as a siphon and thereby move at least a portion of the thermally conductive liquid from the first thermal transfer bag 110 into the second thermal transfer bag 120.

As shown in FIGS. 1A and 1C, in some implementations, the second thermal transfer bag 120 may be configured so that the ambulation, or movement, of the wearer (e.g., walking) causes at least a portion of the thermally conductive liquid to flow therefrom, through the at least one tube 107, and into the first thermal transfer bag 110. In this way, at least a portion of the thermally conductive liquid may be transferred from the second thermal transfer bag 120 to the first thermal transfer bag 110 to be heated therein. In some implementations, the second thermal transfer bag 120 may be configured so that stepping thereon causes at least a portion of the thermally conductive liquid to flow therefrom, through the at least one tube 107, and into the first thermal transfer bag 110.

As shown in FIGS. 1A-1D, in some implementations, the first thermal transfer bag 110 and/or the second thermal transfer bag 120 may be a flexible bag configured to contain a thermally conductive liquid therein. In some implementations, the first thermal transfer bag 110 and/or the second thermal transfer bag 120 may be configured to conform to the region of the wearer's body that it is in heat exchange contact with.

In some implementations, the first thermal transfer bag 110 and/or the second thermal transfer bag 120 may be fabricated from a flexible, durable plastic film. In some implementations, the first thermal transfer bag 110 and/or the second thermal transfer bag 120 may each comprise two or more sidewalls of plastic film, heat sealed at the edges. In some implementations, the compartment formed between the two or more sidewalls of plastic film may be configured to contain therein at least a portion of the thermally conductive liquid used as part of the thermal regulation system 100. In some implementations, the thermal transfer bags 110, 120 may be formed using any suitable method known to one of ordinary skill in the art and/or from any material suitable for containing therein a thermally conductive liquid that is otherwise suitable for use as part of a thermal regulation system 100.

In some implementations, the first thermal transfer bag 110 may be configured to wrap around the calf portion of the wearer's leg (not shown).

In some implementations, the first thermal transfer bag 110 may have a higher elastic modulus than the second thermal transfer bag 120 due to the use of a stiffer material. In some implementations, the first thermal transfer bag 110 may have the same elastic modulus as the second thermal transfer bag 120. In some implementations, the second thermal transfer bag 120 may have a higher elastic modulus than the first thermal transfer bag 110 due to the use of a stiffer material.

As shown in FIGS. 1B and 1D, in some implementations, the first thermal transfer bag 110 may be configured to contain a larger volume of liquid than the second thermal transfer bag 120. In some implementations, the thermal transfer bags 110, 120 may be configured to contain the same, or approximately the same, volume of liquid. In some implementations, the second thermal transfer bag 120 may be configured to contain a larger volume of liquid than the first thermal transfer bag 110.

In some implementations, the thermally conductive liquid does not necessarily fill the entire available compartment volume of each thermal transfer bag 110, 120. In this way, the thermally conductive liquid may be free to flow from one area of one compartment to another area of the same compartment and thereby allow each thermal transfer bag 110, 120 to adapt and conform to the region of the wearer's body that it is in heat exchange contact with.

As shown in FIGS. 1A-1D, in some implementations, the first thermal transfer bag 110 and the second thermal transfer bag 120 may include a first port 118 and a second port 128, respectively. In some implementations, the first port 118 and the second port 128 may be configured to receive and retain therein a first end and a second end, respectively, of the at least one tube 107. In this way, the first thermal transfer bag 110 and the second thermal transfer bag 120 are placed into fluid communication.

In some implementations, each port 118, 128 may be padded to increase the wearer's comfort when using a sock 105 having an integrated thermal regulation system 100.

In some implementations, the at least one tube 107 may be a hollow, flexible, plastic tube. In some implementations, the at least one tube 107 may have a 2 mm diameter. In some implementations, the diameter of the at least one tube 107 may be greater than 2 mm or less than 2 mm. In some implementations, a tube 107 having a small diameter (e.g., a diameter of ~2 mm) has been found to resist kinking and to be more comfortable when used in conjunction with a sock 105 having an integrated thermal regulation system 100. In some implementations, the at least one tube 107 may be circular and/or flat.

In some implementations, a thermal regulation system 100 may include two or more tubes 107 that are configured to place the thermal transfer bags 110, 120 into fluid communication. In some implementations, when two or more tubes 107 are used as part of a thermal regulation system 100, the two or more tubes 107 may be placed side-by-side. In this way, the additional tubes 107 do not increase the thickness of the thermal regulation system 100 as compared to a thermal regulation system 100 having a single tube 107.

In some implementations, each thermal transfer bag 110, 120 may include an additional port for every additional tube 107 used as part of a thermal regulation system 100.

In some implementations, the first thermal transfer bag 110, the second thermal transfer bag 120, and/or the at least one tube 107 may be insulated. In this way, the amount of heat lost by the thermally conductive liquid to the surrounding environment may be minimized or eliminated. In some implementations, a polyester film (e.g., biaxially-oriented polyethylene terephthalate) may be used to insulate the thermal transfer bags 110, 120 and/or the at least one tube 107. In some implementations, the insulating material may be placed on one or more of the sidewalls of each thermal transfer bag 110, 120. In some implementations, the insulating material may be wrapped around a portion of the at least one tube 107. In some implementations, the first thermal transfer bag 110, the second thermal transfer bag 120, and/or the at least one tube 107 may not be insulated.

Figure 2B:
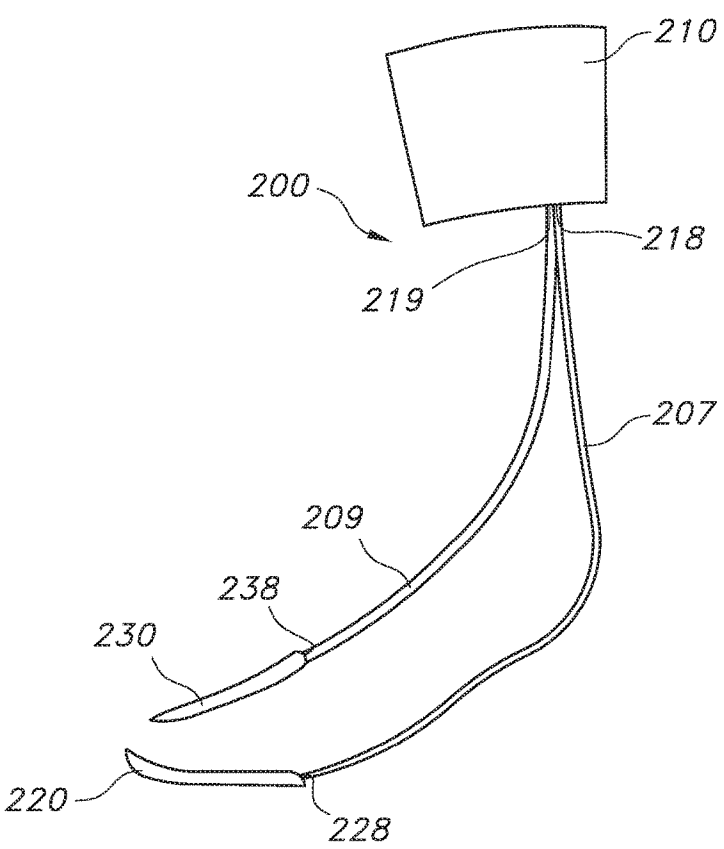
Figure 2A:
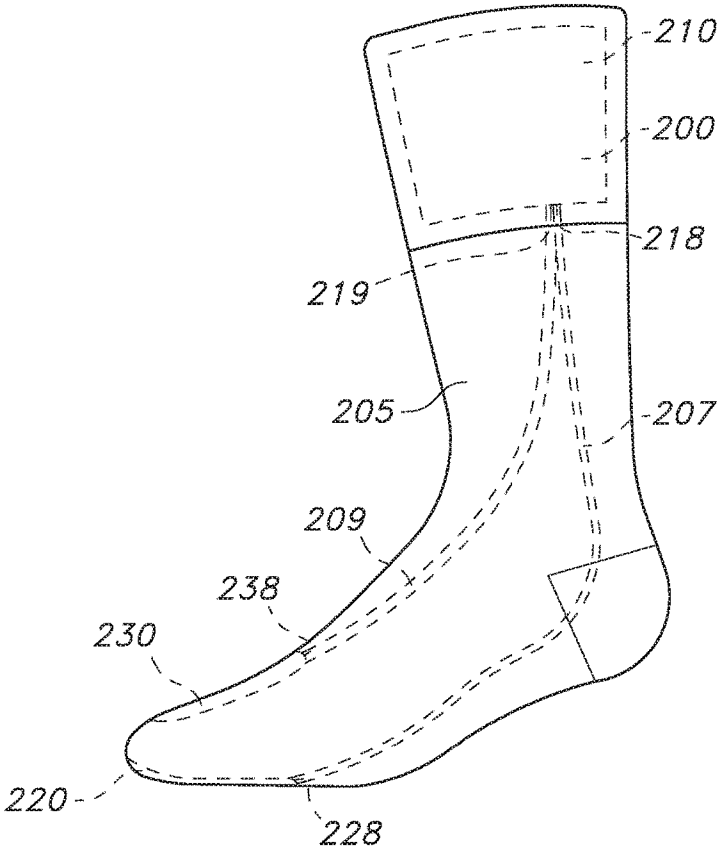

FIGS. 2A and 2B illustrate another example implementation of a thermal regulation system 200 in accordance with the present disclosure. In some implementations, the thermal regulation system 200 is similar to the thermal regulation system 100 discussed above but is further comprised of a third thermal transfer bag 230. In some implementations, a sock 205 may be used to position the third thermal transfer bag 230 in heat exchange contact with the dorsum side of the toes (see, e.g., FIG. 2A). In this way, the top side of the toes may be warmed.

As shown in FIG. 2B, in some implementations, the thermal regulation system 200 may comprise a first thermal transfer bag 210 connected to a second and a third thermal transfer bag 220, 230. In some implementations, a first tube 207 and a second tube 209 place the first thermal transfer bag 210 into fluid communication with the second thermal transfer bag 220 and the third thermal transfer bag 230, respectively. In some implementations, the first, second, and third thermal transfer bags 210, 220, 230 may be configured to contain, and transfer therebetween via the first and second tubes 207, 209, a thermally conductive liquid (e.g., water).

In some implementations, the thermal regulation system 200 may be used by positioning the first thermal transfer bag 210 in heat exchange contact with a relatively warm first region of the wearer's body (e.g., the calf portion of the leg), the second thermal transfer bag 220 in heat exchange contact with a second region of the wearer's body (e.g., the plantar side of the toes), and the third thermal transfer bag in heat exchange contact with a third region of the wearer's body (e.g., the dorsum side of the toes). In this way, heat may be transferred from the relatively warm first region to the second and/or third regions of the wearer's body by the thermally conductive liquid contained within the thermal regulation system 200.

As shown in FIG. 2A, in some implementations, the thermal regulation system 200 may be integrated into a sock 205. In some implementations, the sock 205 with an integrated thermal regulation system 200 may be configured to circulate at least a portion of the thermally conductive liquid between the first thermal transfer bag 210 and the second and/or third thermal transfer bags 220, 230. In some implementations, the sock 205 may be used to position the first thermal transfer bag 210 in heat exchange contact with the calf portion of the leg, the second thermal transfer bag 220 in heat exchange contact with the plantar side of the toes, or other portion of the foot, and the third thermal transfer bag 230 in heat exchange contact with the dorsum side of the toes, or other portion of the foot.

In some implementations, the third thermal transfer bag 230 may be configured so that the ambulation, or movement, of the wearer (e.g., walking) causes at least a portion of the thermally conductive liquid to flow therefrom, through the second tube 209, and into the first thermal transfer bag 210. In this way, at least a portion of the thermally conductive liquid may be transferred from the third thermal transfer bag 230 to the first thermal transfer bag 210 to be heated therein.

In some implementations, the third thermal transfer bag 230 may be fabricated using any method and/or material suitable for fabricating a first thermal transfer bag 110, 210 and/or a second thermal transfer bag 120, 220 as discussed above.

In some implementations, the third thermal transfer bag 230 may have a higher elastic modulus than the first and/or second thermal transfer bags 210, 220 due to the use of a stiffer material. In some implementations, the third thermal transfer bag 230 may have a lower elastic modulus than the first and/or second thermal transfer bags 210, 220 due to the use of a more flexible material. In some implementations, the third thermal transfer bag 230 may have the same elastic modulus as the first and/or second thermal transfer bags 210, 220.

As shown in FIGS. 2A and 2B, in some implementations, the first thermal transfer bag 210 may be configured to contain a larger volume of liquid than the second and/or third thermal transfer bags 220, 230. In some implementations, the thermal transfer bags 210, 220, 230 may be configured to contain the same, or approximately the same, volume of liquid. In some implementations, the third thermal transfer bag 230 may be configured to contain a lower volume of liquid than the first thermal transfer bag 210 and/or the second thermal transfer bag 220.

As shown in FIGS. 2A and 2B, in some implementations, the first thermal transfer bag 210 may include a first port 218 and a second port 219, the second thermal transfer bag 220 may include a third port 228, and the third thermal transfer bag 230 may include a fourth port 238.

In some implementations, the first port 218 and the third port 228 may be configured to receive and retain therein a first end and a second end, respectively, of the first tube 207. In this way, the first thermal transfer bag 210 and the second thermal transfer bag 220 are placed into fluid communication (see, e.g., FIG. 2B).

In some implementations, the second port 219 and the fourth port 238 may be configured to receive and retain therein a first end and a second end, respectively, of the second tube 209. In this way, the first thermal transfer bag 210 and the third thermal transfer bag 230 are placed into fluid communication (see, e.g., FIG. 2B).

In some implementations, the first tube 207 and/or the second tube 209, may be the same as, or similar to, the at least one tube 107 described above.

In some implementations, two or more tubes 207, 209 may be used to place the first thermal transfer bag 210 into fluid communication with the second and/or third thermal transfer bags 220, 230.

Figure 3B:
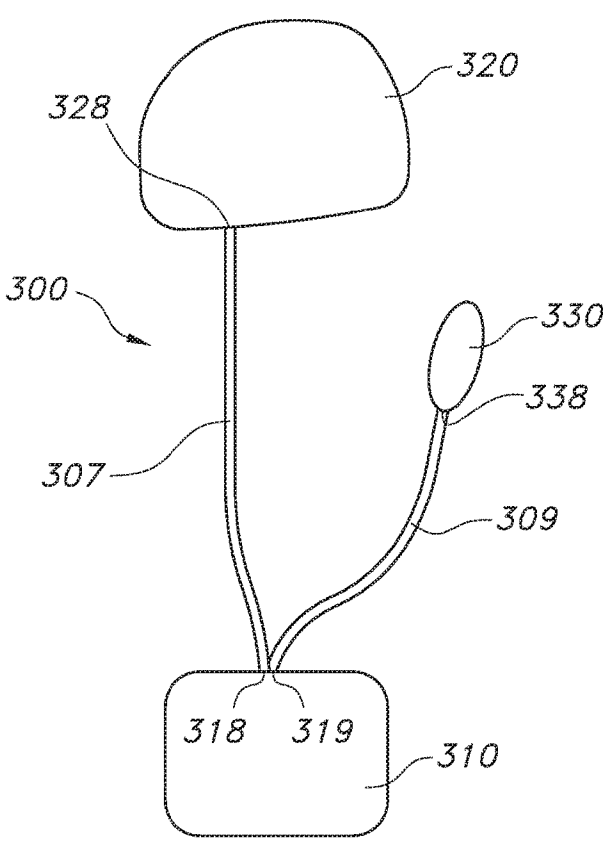
Figure 3A:
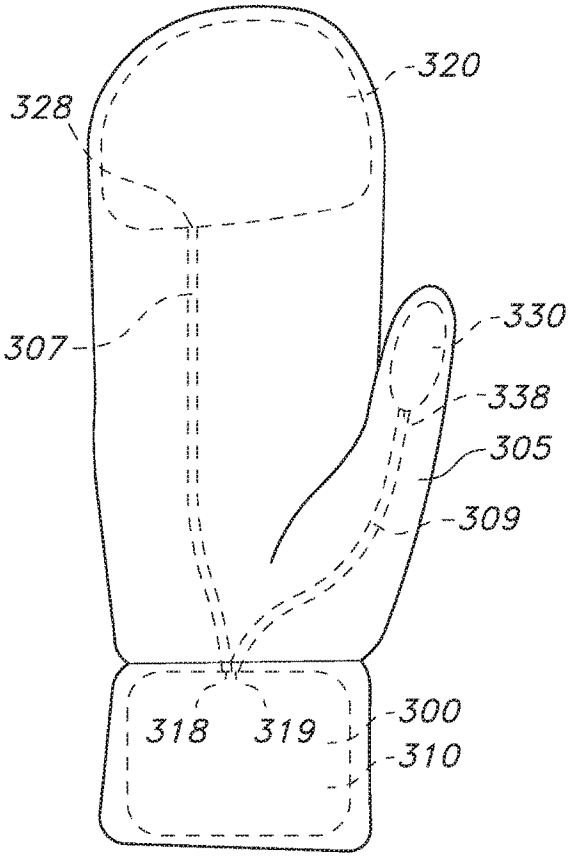

FIGS. 3A and 3B illustrate yet another example implementation of a thermal regulation system 300 in accordance with the present disclosure. In some implementations, the thermal regulation system 300 is similar to the thermal regulation systems 100, 200 discussed above but has been integrated into a mitten 305. In this way, the thermal regulation system 300 may be used to warm the dorsal side of the fingers (see, e.g., FIG. 3A).

As shown in FIG. 3B, in some implementations, the thermal regulation system 300 may comprise a first thermal transfer bag 310 connected to a second and a third thermal transfer bag 320, 330. In some implementations, a first tube 307 and a second tube 309 place the first thermal transfer bag 310 into fluid communication with the second thermal transfer bag 320 and the third thermal transfer bag 330, respectively. In some implementations, the first, second, and third thermal transfer bags 310, 320, 330 may be configured to contain, and transfer therebetween via the first and second tubes 307, 309, a thermally conductive liquid (e.g., water).

As shown in FIG. 3A, in some implementations, the thermal regulation system 300 may be integrated into a mitten 305. In some implementations, the mitten 305 with an integrated thermal regulation system 300 may be configured so that the wearer can circulate at least a portion of the thermally conductive liquid between the first thermal transfer bag 310 and the second and third thermal transfer bags 320, 330. In some implementations, the mitten 305 may be used to position the first thermal transfer bag 310 in heat exchange contact with the wrist portion of the arm, the second thermal transfer bag 320 in heat exchange contact with the dorsal side of the index, middle, ring, and little fingers, and the third thermal transfer bag 330 in heat exchange contact with the dorsal side of the thumb finger (see, e.g., FIG. 3A). By positioning the thermal transfer bags 320, 330 on the dorsal side of the fingers, the amount of tactical sensation lost while wearing the mitten 305 is minimized.

As shown in FIG. 3A, in some implementations, the first thermal transfer bag 310 may be configured so that gravity allows at least a portion of the thermally conductive liquid to flow therefrom, through the first tube 307 and/or the second tube 309, and into the second and/or third thermal transfer bags 320, 330. In this way, heat may be transferred from a relatively warm first region of the wearer's body (e.g., wrist portion of the arm) to a second region of the wearer's body (e.g., the dorsal side of the index, middle, ring, and little fingers) and/or a third region of the wearer's body (e.g., the dorsal side of the thumb finger) by the thermally conductive liquid.

In some implementations, an elastic band or other compression strap may be positioned about the exterior of the first thermal transfer bag 310 and/or the arm to which it is in heat exchange contact with (not shown). In this way, the compression strap may be used to force at least a portion of the thermally conductive liquid from the first thermal transfer bag 310, through the first tube 307 and/or second tube 309, and into the second and/or third thermal transfer bags 320, 330. In some implementations, the thermal regulation system 300 may not be used in conjunction with a compression strap.

As shown in FIG. 3A, in some implementations, pressing (or squeezing) the second thermal transfer bag 320 may cause at least a portion of the thermally conductive liquid contained therein to flow therefrom, through the first tube 307, and into the first thermal transfer bag 310. In this way, at least a portion of the thermally conductive liquid may be transferred from the second thermal transfer bag 320 to the first thermal transfer bag 310 to be heated therein.

As shown in FIG. 3A, in some implementations, pressing (or squeezing) the third thermal transfer bag 330 may cause at least a portion of the thermally conductive liquid contained therein to flow therefrom, through the second tube 309, and into the first thermal transfer bag 310. In this way, at least a portion of the thermally conductive liquid may be transferred from the third thermal transfer bag 320 to the first thermal transfer bag 310 to be heated therein.

In some implementations, the first, second, and third thermal transfer bags 310, 320, 330 may be fabricated using any method and/or material suitable for fabricating a first thermal transfer bag 110, 210, a second thermal transfer bag 120, 220, and/or a third thermal transfer bag 230 as discussed above.

In some implementations, the first thermal transfer bag 310 may be configured to wrap about the wrist portion of the wearer's arm (not shown). In some implementations, the mitten 305 may be configured to position the first thermal transfer bag 310 on the wearer's palm, or other portion of the hand and/or arm.

As shown in FIGS. 3A and 3B, in some implementations, the first thermal transfer bag 310 may be configured to contain a larger volume of liquid than the second and/or third thermal transfer bags 320, 330. In some implementations, the thermal transfer bags 310, 320, 330 may be configured to contain the same, or approximately the same, volume of liquid. In some implementations, the second thermal transfer bag 320 may be configured to contain a larger volume of liquid than the first thermal transfer bag 310 and/or the third thermal transfer bag 330.

As shown in FIGS. 3A and 3B, in some implementations, the first thermal transfer bag 310 may include a first port 318 and a second port 319, the second thermal transfer bag 320 may include a third port 328, and the third thermal transfer bag 330 may include a fourth port 338.

In some implementations, the first port 318 and the third port 328 may be configured to receive and retain therein a first end and a second end, respectively, of the first tube 307. In this way, the first thermal transfer bag 310 and the second thermal transfer bag 320 are placed into fluid communication (see, e.g., FIG. 3B).

In some implementations, the second port 319 and the fourth port 338 may be configured to receive and retain therein a first end and a second end, respectively, of the second tube 309. In this way, the first thermal transfer bag 310 and the third thermal transfer bag 330 are placed into fluid communication (see, e.g., FIG. 3B).

In some implementations, the first tube 307 and/or the second tube 309, may be the same as, or similar to, the tubes 107, 207, 209 described above.

In some implementations, two or more tubes 307, 309 may be used to place the first thermal transfer bag 310 into fluid communication with the second and/or third thermal transfer bags 320, 330.

In some implementations, the thermal regulation system 300 may be configured to warm the dorsal side, the palmar side, and/or lateral sides of the fingers (not shown).

In some implementations, if a thermal transfer bag (e.g., 320) is positioned adjacent the palmar side of the fingers by the mitten 305, the thermal transfer bag (e.g., 320) may be configured so that making a fist or otherwise compressing the fingers (i.e., the index, middle, ring, and little fingers) against the palm causes at least a portion of the thermally conductive liquid to flow therefrom, through a tube (e.g., 307), and into the first thermal transfer bag 310. In this way, at least a portion of the thermally conductive liquid may be transferred from the thermal transfer bag positioned adjacent the palmar side of the fingers, to the first thermal transfer bag 310 to be heated therein.

In some implementations, if a thermal transfer bag (e.g., 330) is positioned adjacent the palmar side of the thumb finger by the mitten 305, the thermal transfer bag (e.g., 330) may be configured so that making a fist or otherwise compressing the thumb finger against the palm causes at least a portion of the thermally conductive liquid to flow therefrom, through a tube (e.g., 309), and into the first thermal transfer bag 310. In this way, at least a portion of the thermally conductive liquid may be transferred from the thermal transfer bag positioned adjacent the palmar side of the thumb finger, to the first thermal transfer bag 310 to be heated therein.

In some implementations, the thermal regulation system 300 may not include a third thermal transfer bag 330.

Figure 4B:
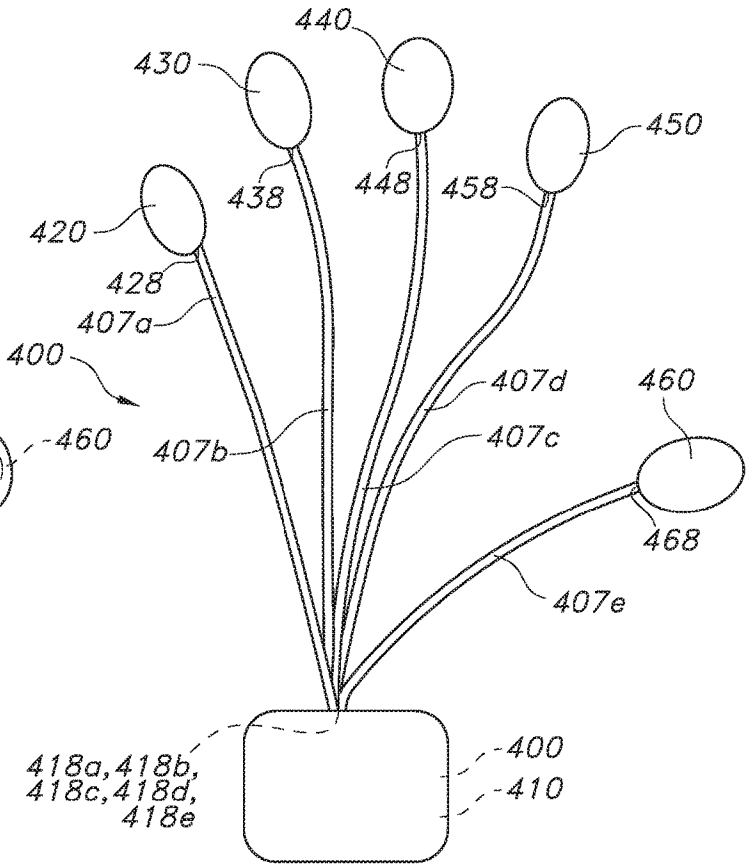
Figure 4A:
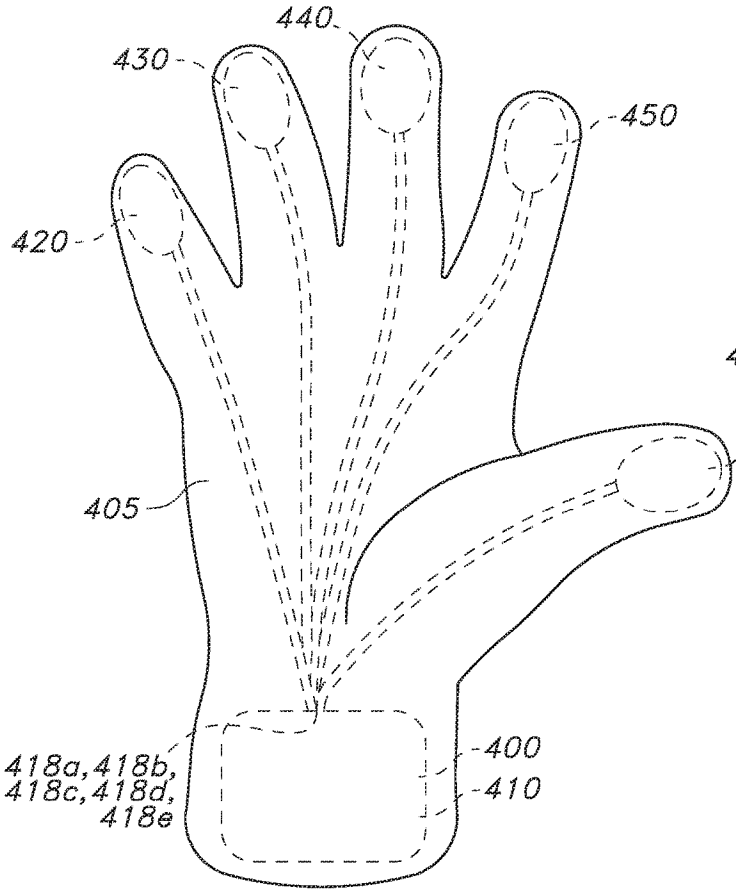

FIGS. 4A and 4B illustrate still yet another example implementation of a thermal regulation system 400 in accordance with the present disclosure. In some implementations, the thermal regulation system 400 is similar to the thermal regulation systems 100, 200, 300 discussed above but has been integrated into a glove 405. In this way, the thermal regulation system 400 may be used to warm the dorsal side of each finger individually (see, e.g., FIG. 4A). By positioning the thermal transfer bags 420, 430, 440, 450, 460 on the dorsal side of the fingers, the amount of tactical sensation lost while wearing the glove 405 is minimized.

As shown in FIG. 4B, in some implementations, the thermal regulation system 400 may comprise a first thermal transfer bag 410 connected to a second thermal transfer bag 420, a third thermal transfer bag 430, a fourth thermal transfer bag 440, a fifth thermal transfer bag 450, and a sixth thermal transfer bag 460. In some implementations, a first tube 407*a*, a second tube 407*b*, a third tube 407*c*, a fourth tube 407*d*, and a fifth tube 407*e* (collectively tubes 407) place the first thermal transfer bag 410 into fluid communication with the other thermal transfer bags 420, 430, 440, 450, 460 (see, e.g., FIG. 4B). In some implementations, the thermal transfer bags 410, 420, 430, 440, 450, 460 may be configured to contain, and transfer therebetween via the tubes 407, a thermally conductive liquid (e.g., water).

As shown in FIG. 4A, in some implementations, the thermal regulation system 400 may be integrated into a glove 405. In some implementations, the glove 405 with an integrated thermal regulation system 400 may be configured so that the wearer can circulate at least a portion of the thermally conductive liquid between the first thermal transfer bag 410 and the other thermal transfer bags 420, 430, 440, 450, 460 positioned within the finger sheaths of the glove 405 (see, e.g., FIG. 4A). In some implementations, the glove 405 may be used to position the first thermal transfer bag 410 in heat exchange contact with the wrist portion of the arm, the second thermal transfer bag 420 in heat exchange contact with the dorsal side of the index finger, the third thermal transfer bag 430 in heat exchange contact with the dorsal side of the middle finger, the fourth thermal transfer bag 440 in heat exchange contact with the dorsal side of the ring finger, the fifth thermal transfer bag 450 in heat exchange contact with the dorsal side of the little finger, and the sixth thermal transfer bag 460 in heat exchange contact with the dorsal side of the thumb finger (see, e.g., FIG. 4A).

As shown in FIG. 4A, in some implementations, the first thermal transfer bag 410 may be configured so that gravity allows at least a portion of the thermally conductive liquid to flow therefrom, through the first, second, third, fourth, and/or fifth tubes 407, and into the connected thermal transfer bag(s) 420, 430, 440, 450, 460. In this way, heat may be transferred from a relatively warm first region of the wearer's body (e.g., a wrist portion of the arm) to other regions of the wearer's body (e.g., the dorsal side of the index, middle, ring, little, and/or thumb fingers) by the thermally conductive liquid.

As shown in FIG. 4A, in some implementations, pressing (or squeezing) the thermal transfer bags (e.g., 420, 430, 440, 450, 460) may cause at least a portion of the thermally conductive liquid contained therein to flow therefrom, through the tubes 407, and into the first thermal transfer bag 410. In this way, at least a portion of the thermally conductive liquid may be transferred from the second, third, fourth, fifth, and/or sixth thermal transfer bags 420, 430, 440, 450, 460 to the first thermal transfer bag 410 to be heated therein.

In some implementations, the thermal transfer bags 410, 420, 430, 440, 450, 460 may be fabricated using any method and/or material suitable for fabricating a first thermal transfer bag 110, 210, 310, a second thermal transfer bag 120, 220, 320, and/or a third thermal transfer bag 230, 330 as discussed above.

In some implementations, the first thermal transfer bag 410 may be configured to wrap about the wrist portion of the wearer's arm (not shown). In some implementations, the glove 405 may be configured to position the first thermal transfer bag 410 on the wearer's palm.

As shown in FIGS. 4A and 4B, in some implementations, the first thermal transfer bag 410 may be configured to contain a larger volume of liquid than the other thermal transfer bags 420, 430, 440, 450, 460. In some implementations, one or more of the thermal transfer bags 410, 420, 430, 440, 450, 460 may be configured to contain the same, or approximately the same, volume of liquid.

As shown in FIGS. 4A and 4B, in some implementations, the first thermal transfer bag 410 may include a first port 418*a*, a second port 418*b*, a third port 418*c*, a fourth port 418*d*, and a fifth port 418*e*, the second thermal transfer bag 420 may include a sixth port 428, the third thermal transfer bag 430 may include a seventh port 438, the fourth thermal transfer bag 440 may include an eighth port 448, the fifth thermal transfer bag 450 may include a ninth port 458, and the sixth thermal transfer bag 460 may include a tenth port 468.

In some implementations, the first port 418*a* and the sixth port 428 may be configured to receive and retain therein a first end and a second end, respectively, of the first tube 407*a*. In this way, the first thermal transfer bag 410 and the second thermal transfer bag 420 are placed into fluid communication (see, e.g., FIG. 4B).

In some implementations, the second port 418*b* and the seventh port 438 may be configured to receive and retain therein a first end and a second end, respectively, of the second tube 407*b*. In this way, the first thermal transfer bag 410 and the third thermal transfer bag 430 are placed into fluid communication (see, e.g., FIG. 4B).

In some implementations, the third port 418*c* and the eighth port 448 may be configured to receive and retain therein a first end and a second end, respectively, of the third tube 407*c*. In this way, the first thermal transfer bag 410 and the fourth thermal transfer bag 440 are placed into fluid communication (see, e.g., FIG. 4B).

In some implementations, the fourth port 418*d* and the ninth port 458 may be configured to receive and retain therein a first end and a second end, respectively, of the fourth tube 407*d*. In this way, the first thermal transfer bag 410 and the fifth thermal transfer bag 450 are placed into fluid communication (see, e.g., FIG. 4B).

In some implementations, the fifth port 418*e* and the tenth port 468 may be configured to receive and retain therein a first end and a second end, respectively, of the fifth tube 407*e*. In this way, the first thermal transfer bag 410 and the sixth thermal transfer bag 460 are placed into fluid communication (see, e.g., FIG. 4B).

In some implementations, the tubes 407 may be the same as, or similar to, the tubes 107, 207, 209, 307, 309 described above.

In some implementations, two or more tubes 407 may be used to place the first thermal transfer bag 410 into fluid communication with each of the other thermal transfer bags 420, 430, 440, 450, 460.

In some implementations, the thermal regulation system 400 may be configured to warm the dorsal side, the palmar side, and/or lateral sides of each finger individually (not shown).

In some implementations, if thermal transfer bags are positioned adjacent the palmar side of the fingers by the glove 405, the thermal transfer bags (e.g., 420, 430, 440, 450, 460) may be configured so that making a fist or otherwise compressing the fingers (i.e., the index, middle, ring, little, and/or thumb fingers) against the palm causes at least a portion of the thermally conductive liquid to flow therefrom, through the connecting tubes (e.g., 407), and into the first thermal transfer bag 410. In this way, at least a portion of the thermally conductive liquid may be transferred from the thermal transfer bags positioned adjacent the palmar side of the fingers, to the first thermal transfer bag 410 to be heated therein.

In some implementations, the thermal regulation system 400 may not include a sixth thermal transfer bag 460.

In some implementations, an integrated thermal regulation system (e.g., 100, 200, 300, 400) may be configured to cool a portion of a wearer's body (e.g., the foot) without employing an outside source of energy.

Figure 5A:
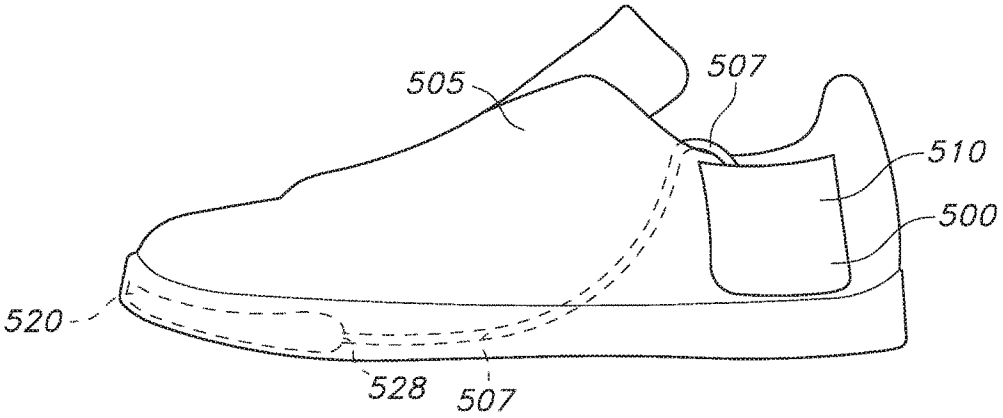
Figure 5B:
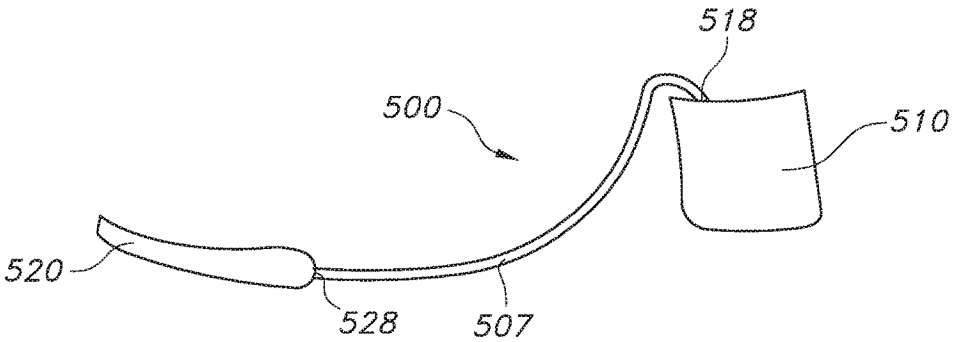

FIGS. 5A and 5B illustrate yet another example implementation of a thermal regulation system 500 in accordance with the present disclosure. In some implementations, the thermal regulation system 500 is similar to the thermal regulation systems 100, 200, 300, 400 discussed above but has been integrated into a shoe 505 and is configured to cool a region of the wearer's body using the heat transfer properties thereof.

As shown in FIG. 5B, in some implementations, the thermal regulation system 500 may comprise a first thermal transfer bag 510 connected to a second thermal transfer bag 520 by at least one tube 507. In some implementations, the at least one tube 507 places the first thermal transfer bag 510 into fluid communication with the second thermal transfer bag 520. In some implementations, the first and second thermal transfer bags 510, 520 may be configured to contain, and transfer therebetween via the at least one tube 507, a thermally conductive liquid (e.g., water). In some implementations, the thermal regulation system 500 may be configured to facilitate a bi-directional flow of the thermally conductive liquid therein.

As shown in FIG. 5A, in some implementations, the thermal regulation system 500 may be integrated into a shoe 505. In some implementations, the shoe 505 with an integrated thermal regulation system 500 may be configured to circulate at least a portion of the thermally conductive liquid between the first thermal transfer bag 510 and the second thermal transfer bag 520. In some implementations, the first thermal transfer bag 510 may be positioned on the exterior of the shoe 505 and the second thermal transfer bag 520 positioned in heat exchange contact with the plantar side of the toes, or other portion of the foot (see, e.g., FIG. 5A). In this way, the first thermal transfer bag 110 is positioned to lose heat to the surrounding environment and thereby allow the thermally conductive fluid within the system 500 to cool.

As shown in FIGS. 5A and 5B, in some implementations, the first thermal transfer bag 510 may be configured so that the at least one tube 507 extends from a top side thereof when positioned on the exterior of the shoe 505. In some implementations, a compression strap may be positioned thereabout and used to force at least a portion of the thermally conductive liquid from the first thermal transfer bag 510, up into and through the at least one tube 507, and into the second thermal transfer bag 520. In this way, the at least one tube 507 may act as a siphon and thereby move at least a portion of the thermally conductive liquid from the first thermal transfer bag 510 into the second thermal transfer bag 520.

As shown in FIG. 5A, in some implementations, the second thermal transfer bag 520 may be configured so that the ambulation, or movement, of the wearer (e.g., walking) causes at least a portion of the thermally conductive liquid to flow therefrom, through the at least one tube 507, and into the first thermal transfer bag 510.

In this way, at least a portion of the thermally conductive liquid may be transferred from the second thermal transfer bag 520 to the first thermal transfer bag 510 to lose heat to the surrounding environment and thereby allow the thermally conductive fluid within the system 500 to cool. In some implementations, the second thermal transfer bag 520 may be configured so that stepping thereon causes at least a portion of the thermally conductive liquid to flow therefrom, through the at least one tube 507, and into the first thermal transfer bag 510.

In some implementations, the first and second thermal transfer bags 510, 520 may be fabricated using any method and/or material suitable for fabricating a first thermal transfer bag 110, 210, 310, 410 and/or a second thermal transfer bag 120, 220, 320, 420 as discussed above.

In some implementations, the first thermal transfer bag 510 may be configured to contain a larger volume of liquid than the second thermal transfer bag 520. In some implementations, the thermal transfer bags 510, 520 may be configured to contain the same, or approximately the same, volume of liquid. In some implementations, the second thermal transfer bag 520 may be configured to contain a larger volume of liquid than the first thermal transfer bag 510.

As shown in FIG. 5B, in some implementations, the first thermal transfer bag 510 may include a first port 518 and the second thermal transfer bag 520 may include a second port 528. In some implementations, the first port 518 and the second port 528 may be configured to receive and retain therein a first end and a second end, respectively, of the at least one tube 507. In this way, the first thermal transfer bag 510 and the second thermal transfer bag 520 may be placed into fluid communication.

In some implementations, the at least one tube 507 may be the same as, or similar to, the tubes 107, 207, 209, 307, 309, 407*a-e* described above.

In some implementations, two or more tubes 507 may be used to place the first thermal transfer bag 510 into fluid communication with the second thermal transfer bag 520.

In some implementations, the thermal regulation system 500 may be configured to cool the plantar side and/or the dorsum side of the toes and/or other portions of the foot (not shown).

Figure 6B:
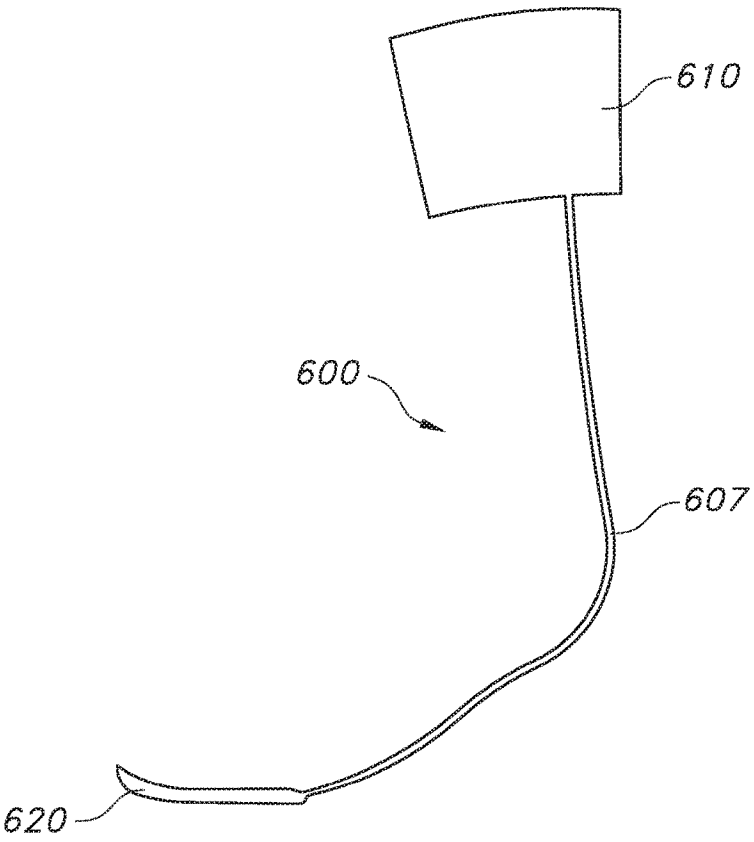
Figure 6A:
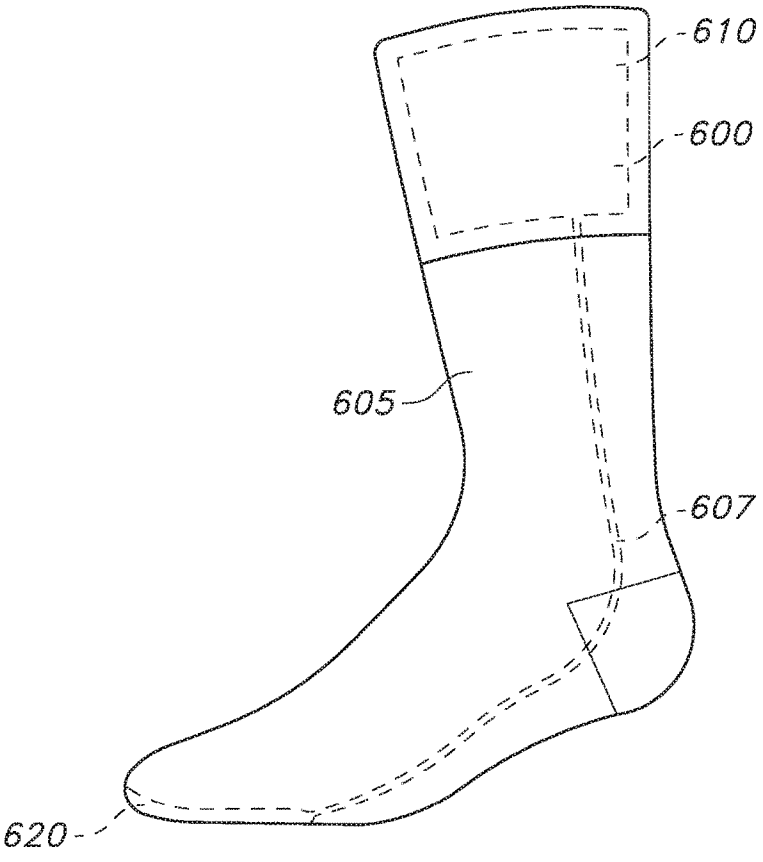
Figure 6D:
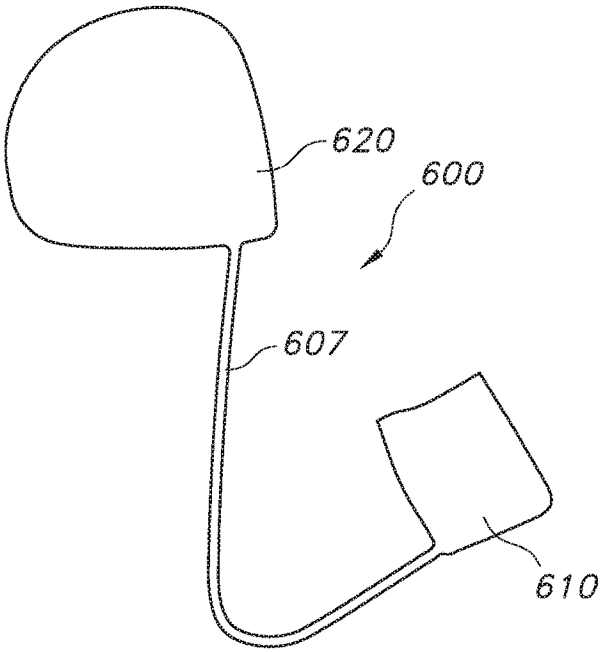
Figure 6C:
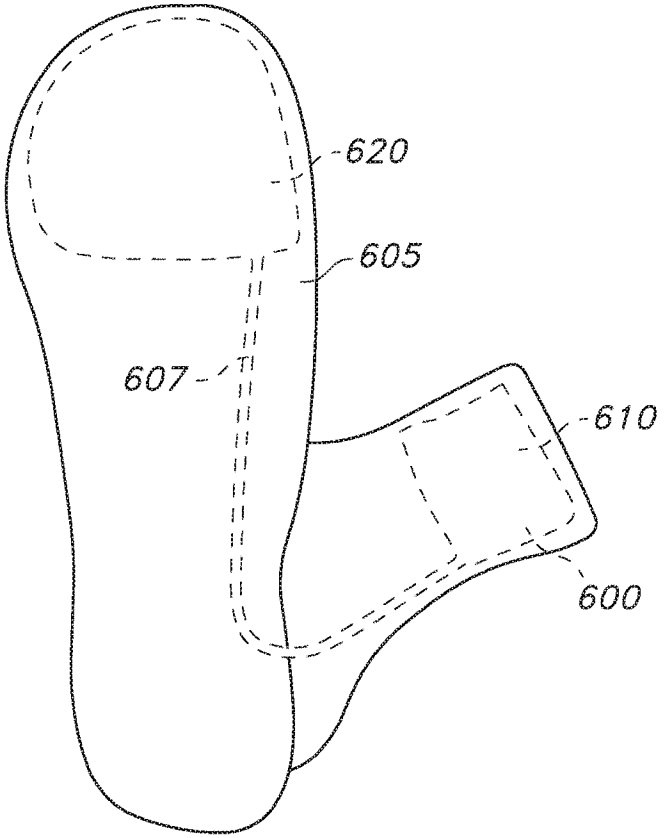

FIGS. 6A-6D illustrate still yet another example implementation of a thermal regulation system 600 in accordance with the present disclosure. In some implementations, the thermal regulation system 600 is similar to the thermal regulation systems 100, 200, 300, 400, 500 discussed above but the first thermal transfer bag 610, the second thermal transfer bag 620, and the tube 607 are a single unitary device. In some implementations, the thermal regulation system 600 may be integrated into a sock 605 as shown in FIGS. 6A and 6C.

As shown in FIGS. 6B and 6D, in some implementations, a first side of the first thermal transfer bag 610, the second thermal transfer bag 620, and the tube 607 is made of a single, first piece of material. In some implementations, a second side of the first thermal transfer bag 610, the second thermal transfer bag 620, and the tube 607 is made of a single, second piece of material. In some implementations, the first piece of material and the second piece of material may be joined together along the edges. In this way, a unitary interior compartment extending between the first thermal transfer bag 610, the tube 607, and the second thermal transfer bag 620 may be formed. Succinctly put, the thermal regulation system 600 is constructed in a manner that does not rely on a port or other connective device to connect the tube 607 to the first thermal transfer bag 610 and/or the second thermal transfer bag 620.

In some implementations, the unitary interior compartment formed between the first piece of material and/or the second piece of material may be configured to contain the total volume of the thermally conductive liquid used as part of the thermal regulation system 600.

In some implementations, the first piece of material and/or the second piece of material may be fabricated from a flexible, durable plastic film. In some implementations, the first piece of material and/or the second piece of material may each comprise two or more layers of plastic film. In some implementations, the first piece of material and the second piece of material may be joined together along the edges using any suitable method (e.g., heat, glue, ultrasonic welding, etc.) known to one of ordinary skill in the art. In some implementations, the first piece of material and/or the second piece of material may be fabricated using any suitable method and/or from any material suitable for containing therein a thermally conductive liquid that is otherwise suitable for use as part of a thermal regulation system 600.

In some implementations, the thermal regulation system 600 may be fabricated from a single piece of material that is configured to form the first thermal transfer bag 610, the second thermal transfer bag 620, and the tube 607 when folded over and sealed along the edges.

As shown in FIGS. 6A and 6C, in some implementations, the sock 605 with an integrated thermal regulation system 600 may be configured to circulate at least a portion of the thermally conductive liquid between the first thermal transfer bag 610 and the second thermal transfer bag 620. In some implementations, the sock 605 may be used to position the first thermal transfer bag 610 in heat exchange contact with the calf portion of the leg and the second thermal transfer bag 620 in heat exchange contact with the plantar side of the toes, or other portion of the foot (e.g., the arch of the foot).

Figure 7B:
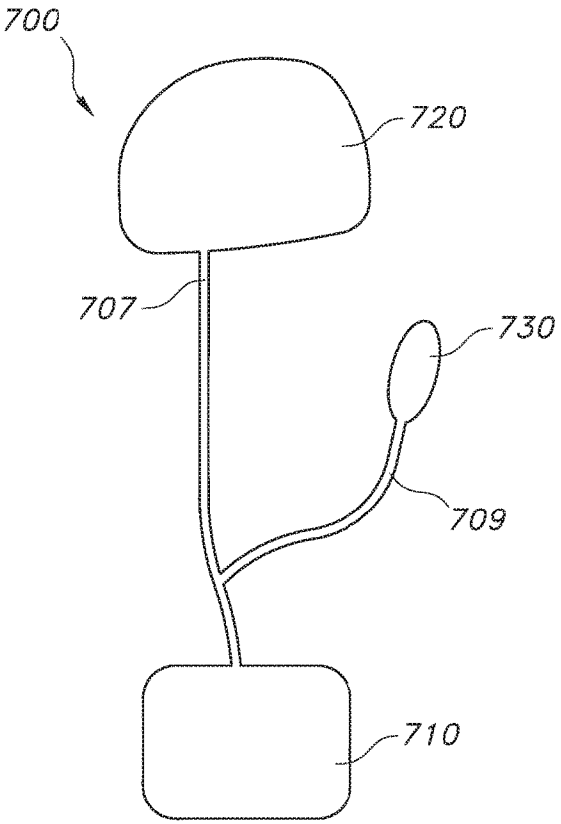
Figure 7A:
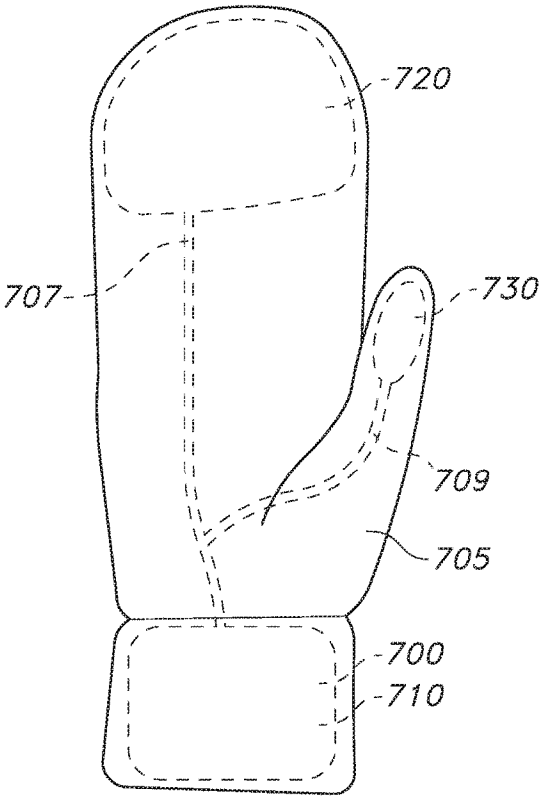

FIGS. 7A and 7B illustrate yet another example implementation of a thermal regulation system 700 in accordance with the present disclosure. In some implementations, the thermal regulation system 700 is similar to the thermal regulation systems 100, 200, 300, 400, 500, 600 discussed above but the first thermal transfer bag 710, the second thermal transfer bag 720, the third thermal transfer bag 730, the first tube 707, and the second tube 709 are a single unitary device. In some implementations, the thermal regulation system 700 may be integrated into a mitten 705 as shown in FIG. 7A.

As shown in FIG. 7B, in some implementations, a first side of the first thermal transfer bag 710, the second thermal transfer bag 720, the third thermal transfer bag 730, the first tube 707, and the second tube 709 is made of a single, first piece of material. In some implementations, a second side of the first thermal transfer bag 710, the second thermal transfer bag 720, the third thermal transfer bag 730, the first tube 707, and the second tube 709 is made of a single, second piece of material. In some implementations, the first piece of material and the second piece of material may be joined together along the edges. In this way, a unitary interior compartment that extends between the first thermal transfer bag 710, the second thermal transfer bag 720, the third thermal transfer bag 720, the first tube 707, and the second tube 709 may be formed (see, e.g., FIG. 7B). Succinctly put, the thermal regulation system 700 is constructed in a manner that does not rely on one or more ports or other connective devices to connect the first tube 707 and/or the second tube 709 to the first thermal transfer bag 710, the second thermal transfer bag 730, and/or the third thermal transfer bag 730.

As shown in FIG. 7B, in some implementations, the second tube 709 may extend between the first tube 707 and the third thermal transfer bag 730. In this way, the third thermal transfer bag 710 is placed into fluid communication with the first thermal transfer bag 710. In some implementations, the junction between the first tube 707 and the second tube 709 may correspond to the palm portion, or an area adjacent thereto, of the mitten 705 (see, e.g., FIG. 7A).

In some implementations, the unitary interior compartment formed between the first piece of material and/or the second piece of material may be configured to contain the total volume of the thermally conductive liquid used as part of the thermal regulation system 700.

In some implementations, the first piece of material and/or the second piece of material may be fabricated from a flexible, durable plastic film. In some implementations, the first piece of material and/or the second piece of material may each comprise one or more layers of plastic film. In some implementations, the first piece of material and the second piece of material may be joined together along the edges using any suitable method (e.g., heat, glue, ultrasonic welding, etc.) known to one of ordinary skill in the art. In some implementations, the first piece of material and/or the second piece of material may be fabricated using any suitable method and/or from any material suitable for containing therein a thermally conductive liquid that is otherwise suitable for use as part of a thermal regulation system 700.

In some implementations, the thermal regulation system 700 may be fabricated from a single piece of material that is configured to form the first thermal transfer bag 710, the second thermal transfer bag 720, the third thermal transfer bag 730, the first tube 707, and the second tube 709 when folded over and sealed along the edges.

As shown in FIGS. 7A and 7B, in some implementations, the mitten 705 with an integrated thermal regulation system 700 may be configured so that the wearer can circulate at least a portion of the thermally conductive liquid between the first thermal transfer bag 710 and the second and third thermal transfer bags 720, 730. In some implementations, the mitten 705 may be used to position the first thermal transfer bag 710 in heat exchange contact with the wrist portion of the arm, the second thermal transfer bag 720 in heat exchange contact with the dorsal side of the index, middle, ring, and little fingers, and the third thermal transfer bag 730 in heat exchange contact with the dorsal side of the thumb finger (see, e.g., FIG. 7A).

Figure 8B:
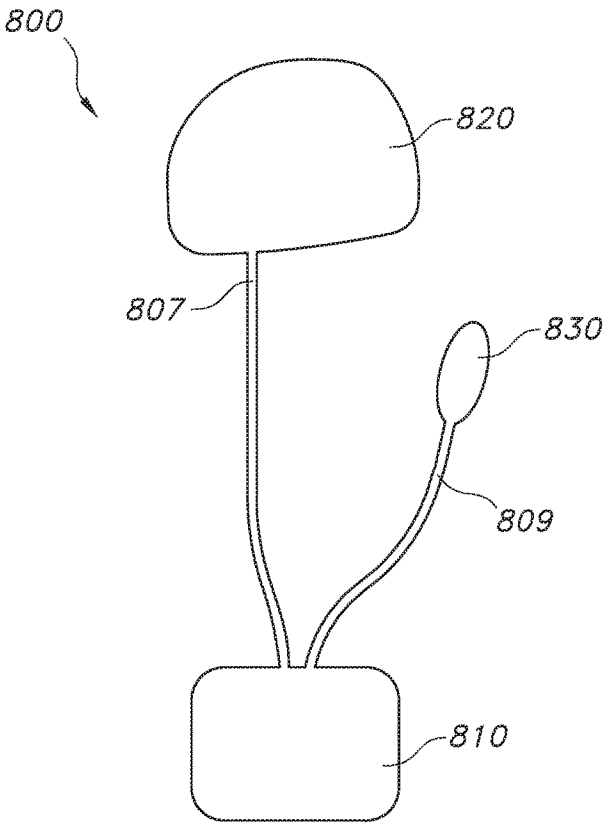
Figure 8A:
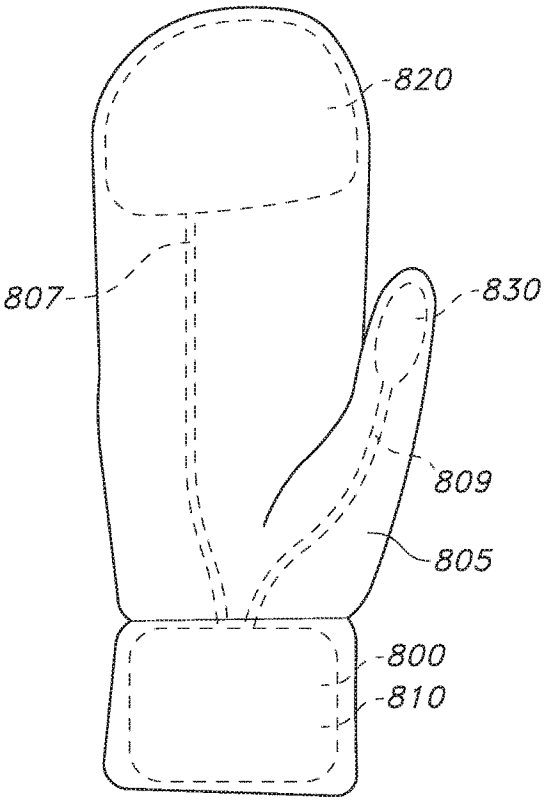

FIGS. 8A and 8B illustrate still yet another example implementation of a thermal regulation system 800 in accordance with the present disclosure. In some implementations, the thermal regulation system 800 is similar to the thermal regulation systems 100, 200, 300, 400, 500, 600, 700 discussed above, in particular the thermal regulation system 700 shown in FIGS. 7A and 7B, but the second tube 809 extends between the first thermal transfer bag 810 and the third thermal transfer bag 830. In this way, the third thermal transfer bag 830 is directly placed into fluid communication with the first thermal transfer bag 810. In some implementations, the first thermal transfer bag 810, the second thermal transfer bag 820, the third thermal transfer bag 830, the first tube 807, and the second tube 809 are a single unitary device. In some implementations, the thermal regulation system 800 may be integrated into a mitten 805 as shown in FIG. 8A.

As shown in FIG. 8A, in some implementations, a first side of the first thermal transfer bag 810, the second thermal transfer bag 820, the third thermal transfer bag 830, the first tube 807, and the second tube 809 is made of a single, first piece of material. In some implementations, a second side of the first thermal transfer bag 810, the second thermal transfer bag 820, the third thermal transfer bag 830, the first tube 807, and the second tube 809 is made of a single, second piece of material. In some implementations, the first piece of material and the second piece of material may be joined together along the edges. In this way, a unitary interior compartment that extends between the first thermal transfer bag 810, the second thermal transfer bag 820, the third thermal transfer bag 820, the first tube 807, and the second tube 809 may be formed (see, e.g., FIG. 8B). Succinctly put, the thermal regulation system 800 is constructed in a manner that does not rely on one or more ports or other connective devices to connect the first tube 807 and/or the second tube 809 to the first thermal transfer bag 810, the second thermal transfer bag 820, and/or the third thermal transfer bag 830.

In some implementations, the thermal regulation system 800 may be fabricated from a single piece of material that is configured to form the first thermal transfer bag 810, the second thermal transfer bag 820, the third thermal transfer bag 830, the first tube 807, and the second tube 809 when folded over and sealed along the edges.

FIGS. 9A-9D illustrate yet another example implementation of a thermal regulation system 900 in accordance with the present disclosure. In some implementations, the thermal regulation system 900 is similar to the thermal regulation systems 100, 200, 300, 400, 500, 600, 700, 800 discussed above, in particular the thermal regulation system 100 shown in FIGS. 1A-1D, but comprises a first thermal transfer bag 910 connected to a second thermal transfer bag 920 by at least one tube 907, wherein the second thermal transfer bag 920 has been configured to envelop at least the toes of the wearer's foot. In some implementations, the thermal regulation system 900 may be integrated into a sock 905 configured to position the toe receptacle 922 of the second thermal transfer bag 920 to receive the wearer's toes therein when the sock 905 is donned. In this way, the second thermal transfer bag 920 may be positioned in heat exchange contact with a wearer's toes (see, e.g., FIGS. 9A and 9C). Thus, the toes may be warmed by a transfer of heat from the second thermal transfer bag 920.

Figure 9B:
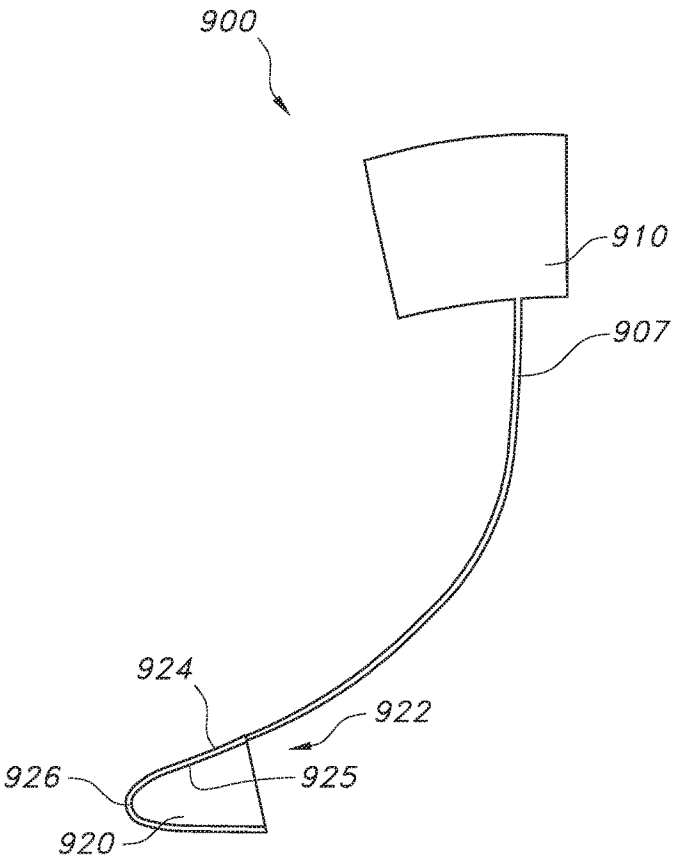
Figure 9A:
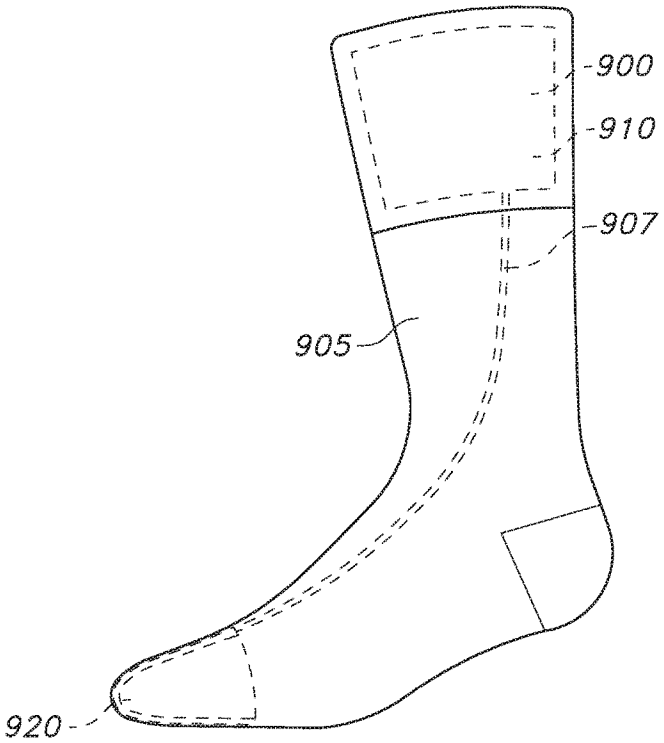

As shown in FIG. 9B, in some implementations, the second thermal transfer bag 920 may comprise at least a first layer of material 924 and a second layer of material 925 secured together to form an interior compartment 926 therebetween that is configured to contain a volume of thermally conductive liquid. In some implementations, the second thermal transfer bag 920 may be configured so that the ambulation, or movement, of the wearer (e.g., walking) causes at least a portion of the thermally conductive liquid contained therein to circulate throughout the interior compartment 926. In this way, the heated thermally conductive liquid is able to warm the dorsum, plantar, and/or lateral sides of the toes. In some implementations, the second thermal transfer bag 920 may be configured so that stepping on the portion thereof positioned underneath the toes, or other portion of the foot, causes at least a portion of the thermally conductive liquid to flow therefrom, through the at least one tube 907, and into the first thermal transfer bag 910.

Figure 9D:
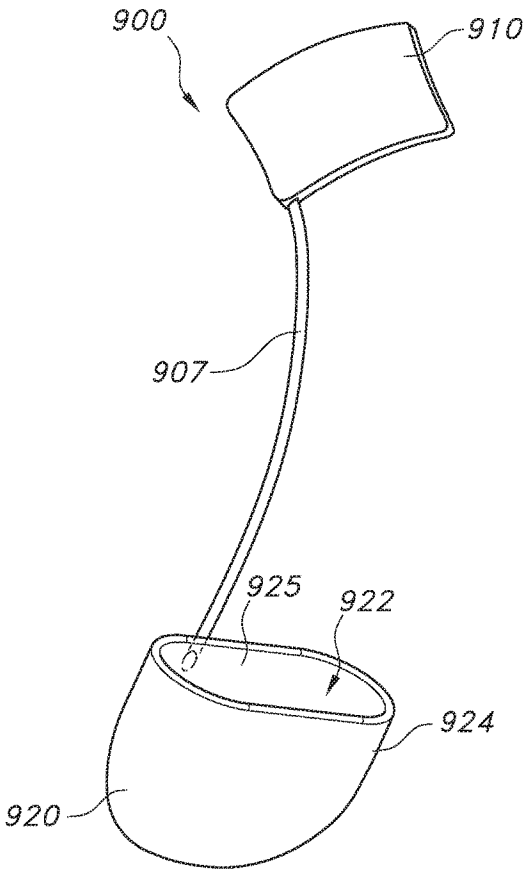
Figure 9C:
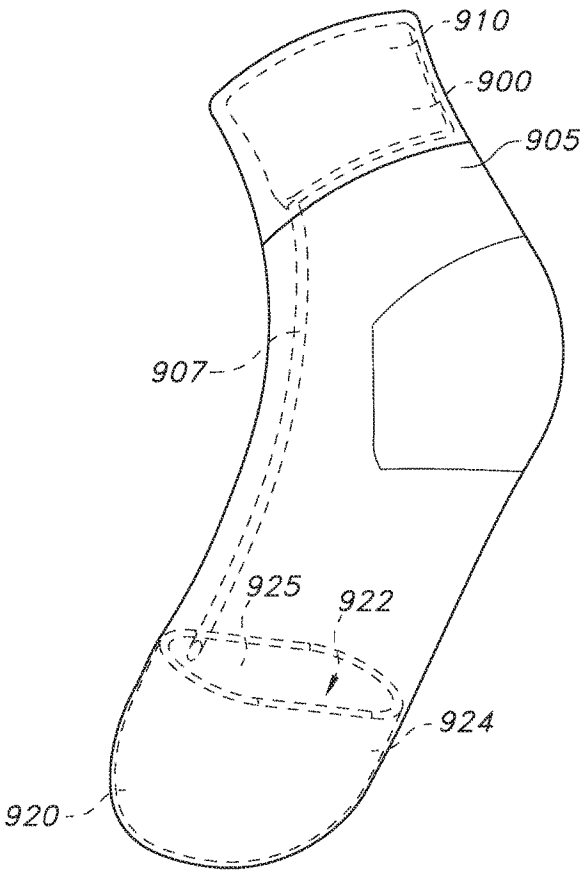

As shown in FIG. 9D, in some implementations, the second thermal transfer bag 920 may be configured (e.g., shaped) to form a receptacle 922 into which at least the toes of a wearer may fit. In this way, the second thermal transfer bag 920 may be configured to envelop the dorsum, plantar, and/or lateral sides of a wearer's toes. In some implementations, the second layer of material 925 may be shaped to form the receptacle 922 of the second thermal transfer bag 920 and thereby place an exterior surface thereof in heat exchange contact with the dorsum, plantar, and/or lateral sides of a wearer's toes and/or other portions of the foot.

As shown in FIG. 9B, in some implementations, the second thermal transfer bag 920 may be configured so that the at least one tube 907 extends from a dorsum side of the second thermal transfer bag 920. In this way, the bulk of the tube 907 may not be felt by the wearer and/or the second thermal transfer bag 920 may be placed into fluid communication with the first thermal transfer bag 910. In some implementations, the at least one tube 907 could extend from another side of the second thermal transfer bag 920.

In some implementations, the first layer of material 924 and/or the second layer of material 925 of the second thermal transfer bag 920 may be flexible. In some implementations, the first layer of material 924 or the second layer of material 925 of the second thermal transfer bag 920 may not be flexible.

FIGS. 10A-10D illustrate still yet another example implementation of a thermal regulation system 1000 in accordance with the present disclosure. In some implementations, the thermal regulation system 1000 is similar to the thermal regulation systems 100, 200, 300, 400, 500, 600, 700, 800, 900 discussed above, in particular the thermal regulation system 200 shown in FIGS. 2A and 2B. In some implementations, the thermal regulation system 1000 may be integrated into a sock 1005 configured to position the first thermal transfer bag 1010 in heat exchange contact with a relatively warm first region of the wearer's body (e.g., the calf portion of the leg), the second thermal transfer bag 1020 in heat exchange contact with a second region of the wearer's body (e.g., the dorsum side of the toes), and the third thermal transfer bag 1030 in heat exchange contact with a third region of the wearer's body (e.g., the plantar side of the toes) (see, e.g., FIGS. 10A and 10C).

Figure 10B:
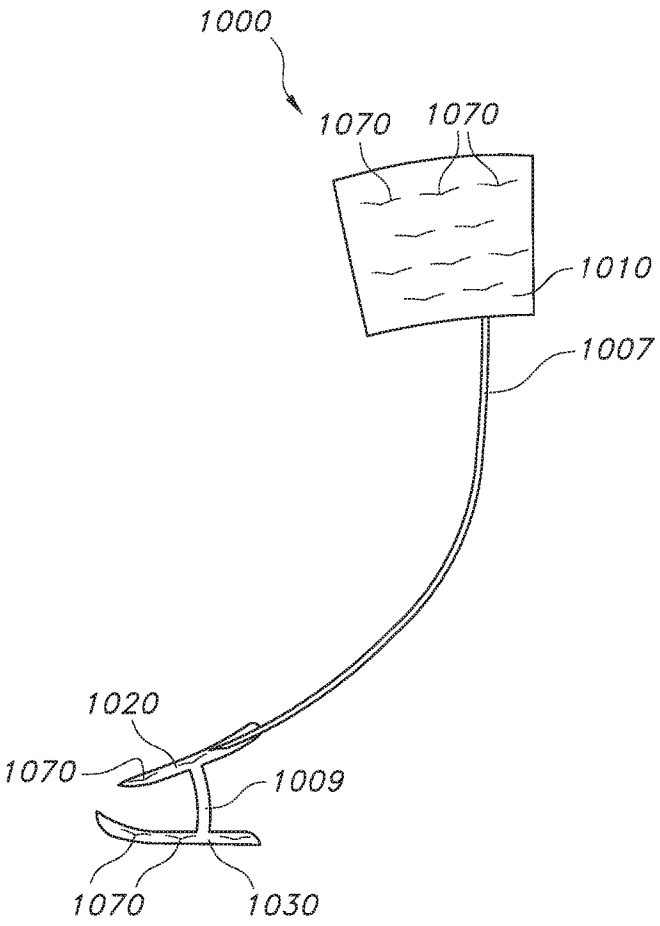
Figure 10A:
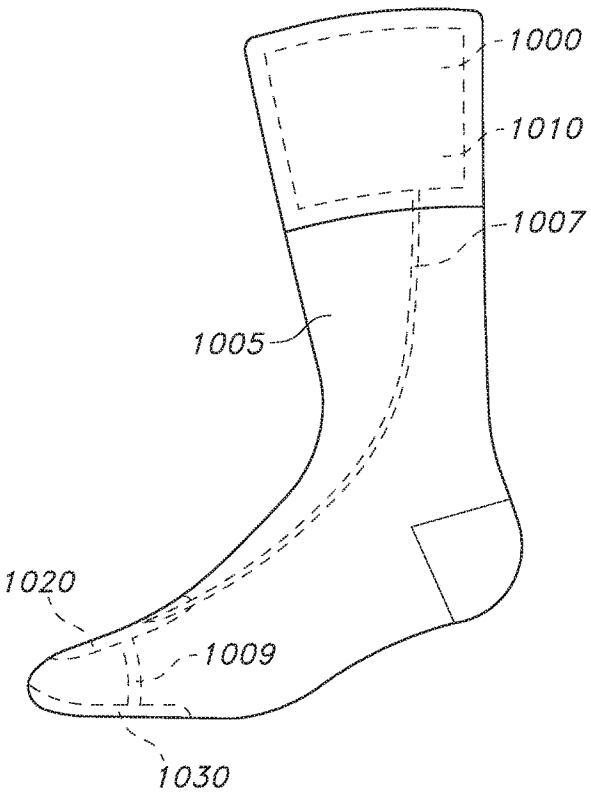
Figure 10D:
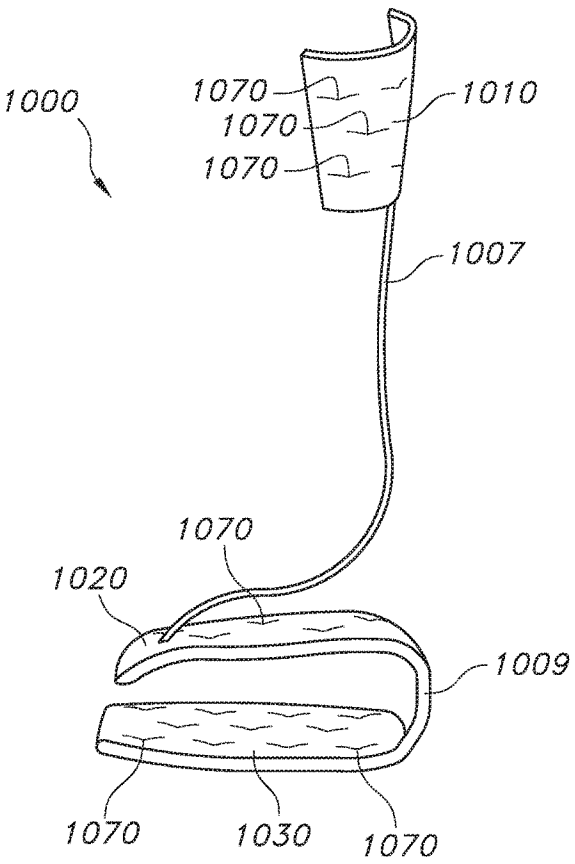
Figure 10C:
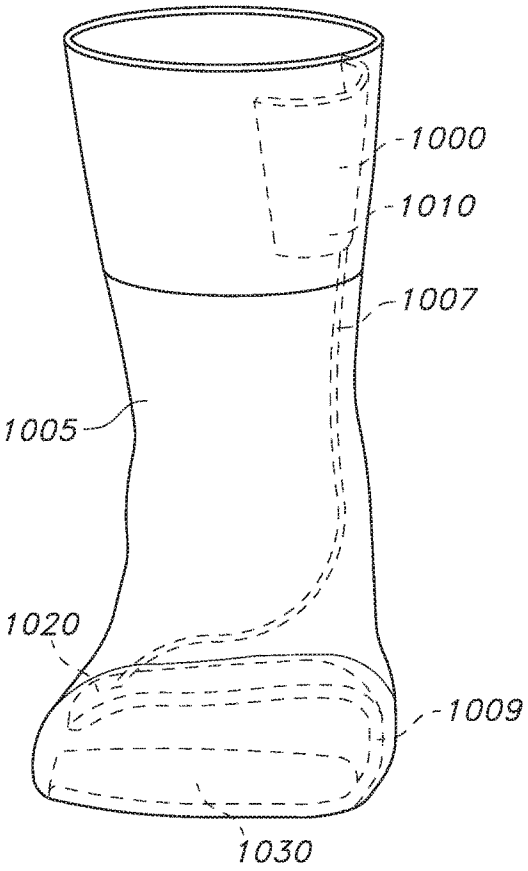

As shown in FIGS. 10B and 10D, in some implementations, the thermal regulation system 1000 may comprise a first thermal transfer bag 1010 connected to a second and a third thermal transfer bag 1020, 1030 by at least one tube 1007. In some implementations, the second and third thermal transfer bags 1020, 1030 may be connected by a conduit 1009 that extends therebetween. In this way, the second and third thermal transfer bags 1020, 1030 may be placed into fluid communication. In some implementations, the first, second, and third thermal transfer bags 1010, 1020, 1030 may be configured to contain, and transfer therebetween via the tube 1007 and the conduit 1009, a thermally conductive liquid (e.g., water).

As shown in FIG. 10B, in some implementations, the conduit 1009 may extend between a first lateral side of the second thermal transfer bag 1020 and a first lateral side of the third thermal transfer bag 1030. In this way, the conduit 1009 is positioned to extend alongside a portion of the foot and thereby minimize, or eliminate, any discomfort to the wearer. Further, positioning the at least one tube 1007 so that the plantar side of the toes, or foot, does not come to rest thereon may be more comfortable for the wearer.

As shown in FIGS. 10B and 10D, in some implementations, the first thermal transfer bag 1010, the second thermal transfer bag 1020, and/or the third thermal transfer bag 1030 of the thermal regulation system 1000 may each include one or more baffles 1070 configured to effect the flow of the thermally conductive liquid contained therein. In some implementations, each baffle 1070 may be configured to restrict the expansion of a thermal transfer bag (e.g., 1010, 1020, 1030), thereby limiting the volume of fluid that can be contained therein. In this way, one or more baffles 1070 may be used to increase the pressure exerted by a thermal transfer bag (e.g., 1010, 1020, 1030) on the thermally conductive liquid contained therein and thereby effect the distribution and flow of the thermally conductive liquid within the thermal regulation system 1000. In some implementations, one or more baffles 1070 may be used to shape a thermal transfer bag (e.g., 1010, 1020, 1030) so that it may be comfortably positioned in heat exchange contact with an external portion of the wearer's body.

In some implementations, one or more baffles 1070 may be configured and/or positioned to ensure an unequal distribution of the thermally conductive liquid contained within a thermal transfer bag (e.g., 1010, 1020, 1030). In some implementations, one or more baffles 1070 may be configured and/or positioned to ensure an equal distribution of the thermally conductive liquid contained within a thermal transfer bag (e.g., 1010, 1020, 1030).

In some implementations, the second thermal transfer bag 1020, positioned on the dorsum side of the toes, may include more baffles 1070 than the third thermal transfer bag 1030 positioned on the plantar side of the toes. In this way, when the wearer steps on the third thermal transfer bag 1030, the expansion of the second thermal transfer bag 1020 is limited by the baffles 1070, thereby urging the volume of thermally conductive liquid flowing therein from the third thermal transfer bag 1030 into the first thermal transfer bag 1010. In some implementations, the third thermal transfer bag 1030 may include more baffles 1070 than the second thermal transfer bag 1020.

In some implementations, thermal transfer bags 1010, 1020, 1030 may have the same number of baffles 1070. In some implementations, the thermal transfer bags 1010, 1020, 1030 may not have the same number of baffles 1070.

In some implementations, each baffle 1070 of a thermal transfer bag 1010, 1020, 1030 may be formed by connecting portions of opposing sidewalls together. In this way, a baffle 1070 may be configured to restrict the expansion of a thermal transfer bag 1010, 1020, 1030. In some implementations, heat may be used to bond the two portions of opposing sidewalls together. In some implementations, the two portions of opposing sidewalls may be secured together using any method known to those of ordinary skill in the art. In some implementations, each baffle 1070 may be round/circular and configured to allow a fluid to flow thereabout. In some implementations, each baffle 1070 may have a rectangular shape and be configured to allow a fluid to flow thereabout. In some implementations, each baffle 1070 may be any suitable shape for use as part of a thermal regulation system 1000. In some implementations, a baffle 1070 could be a structure positioned between two opposing sidewalls of a thermal transfer bag 1010, 1020, 1030 (not shown).

In some implementations, two or more baffles 1070 may be evenly distributed within a thermal transfer bag 1010, 1020, 1030. In some implementations, two or more baffles 1070 may not be evenly distributed within a thermal transfer bag 1010, 1020, 1030. In some implementations, multiple baffles 1070 may be organized as an array within a thermal transfer bag 1010, 1020, 1030. In some implementations, multiple baffles 1070 may not be organized as an array within a thermal transfer bag 1010, 1020, 1030.

In some implementations, the baffles 1070 disclosed in connection with the present thermal regulation system 1000 may be used with any implementation of a thermal regulation system disclosed herein for the same or similar reasons as disclosed in connection with the present thermal regulation system 1000.

FIGS. 11A-11D illustrate yet another example implementation of a thermal regulation system 1100 in accordance with the present disclosure. In some implementations, the thermal regulation system 1100 is similar to the thermal regulation systems 100, 200, 300, 400, 500, 600, 700, 800, 900, 1000 discussed above, in particular the thermal regulation system 1000 shown in FIGS. 10A-10D. In some implementations, the thermal regulation system 1100 may be integrated into a sock 1105 configured to position a first thermal transfer bag 1110 in heat exchange contact with a relatively warm first region of the wearer's body (e.g., the calf portion of the leg) and a second thermal transfer bag 1120 in heat exchange contact with a second region of the wearer's body (e.g., the plantar side of the toes) (see, e.g., FIGS. 11A and 11C).

Figure 11B:
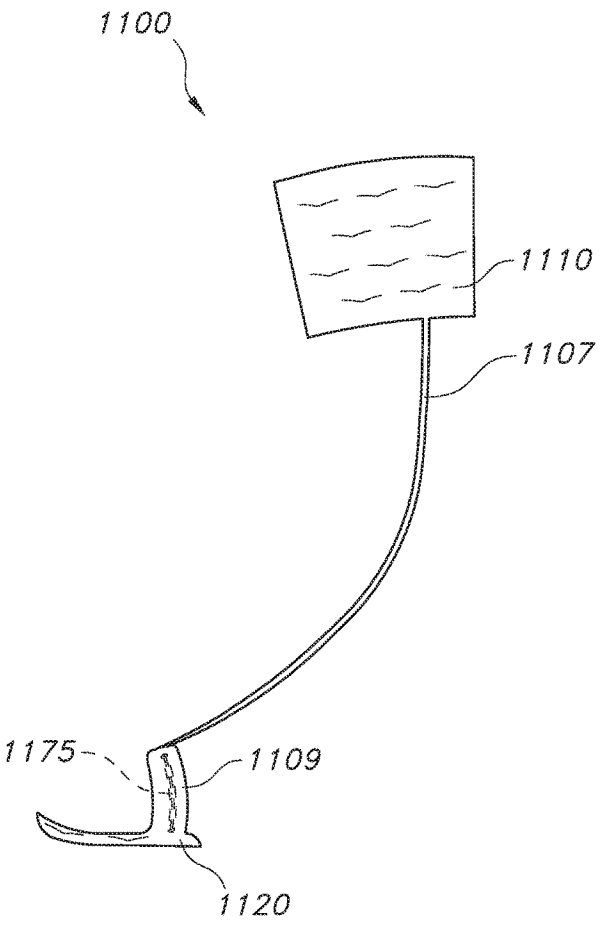
Figure 11A:
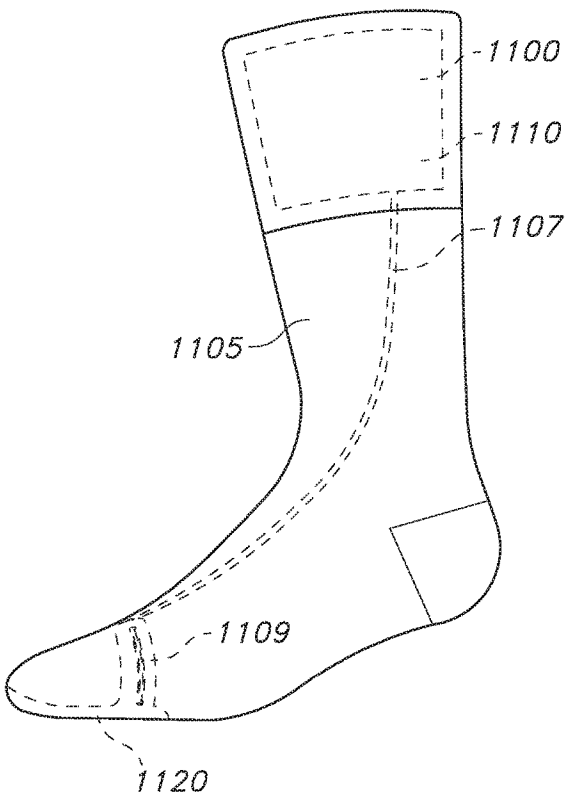
Figure 11D:
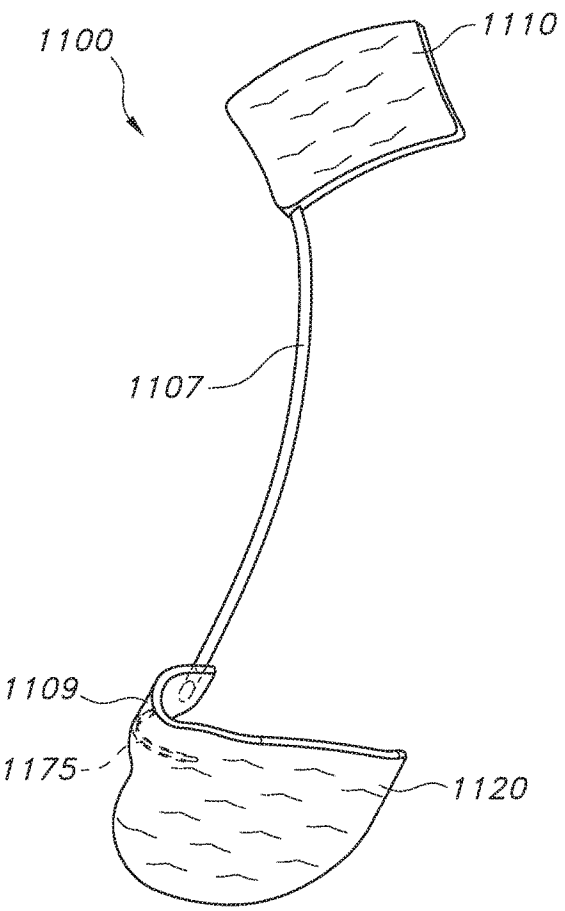
Figure 11C:
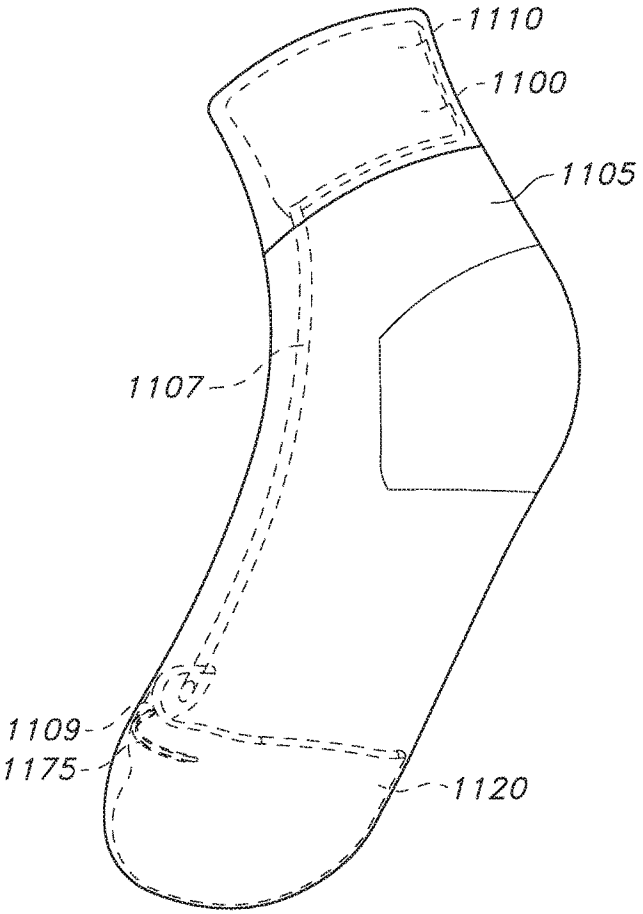

As shown in FIGS. 11B and 11D, in some implementations, the thermal regulation system 1100 may comprise a first thermal transfer bag 1110 connected by at least one tube 1107 to a conduit 1109 extending from a second thermal transfer bag 1120. In some implementations, the conduit 1109 may extend from a first lateral side of the second thermal transfer bag 1120 and thereby be positioned to extend alongside a lateral portion of the foot to thereby minimize, or eliminate, any discomfort to the wearer. In some implementation, the end of the conduit to which the at least one tube 1107 is connected may be positioned adjacent a dorsum side of the foot (see, e.g., FIG. 11C). Positioning the at least one tube 1107 so that the plantar side of the toes, or foot, does not come to rest thereon may be more comfortable for the wearer of the sock 1105. In some implementations, the first and second thermal transfer bags 1110, 1120 may be configured to contain, and transfer therebetween via the tube 1107 and the conduit 1109, a thermally conductive liquid (e.g., water).

As shown in FIG. 11B, in some implementations, a spacer 1175 may be positioned within and extend the length, or the approximate length, of the conduit 1109. In some implementations, the spacer 1175 may be configured and/or positioned to preserve the opening extending through the conduit 1109, thereby allowing the thermally conductive liquid to flow therethrough. In some implementations, the spacer may be configured to prevent the conduit 1109 from being crimped and/or collapsing when the sock 1105 is being worn. In some implementations, the spacer 1175 may be flexible. In some implementations, the spacer 1175 may be a longitudinally extending member having a semi-circular profile, or other suitable shape. In some implementations, more than one spacer 1175 may be used to preserve the opening extending through a conduit 1109 (not shown).

As used throughout the present specification, the phrase "in heat exchange contact" means that the referenced thermal transfer bag (e.g., 110, 120, 210, 220, 230, 310, 320, 330, 410, 420, 430, 440, 450, 460, 520, 610, 620, 710, 720, 730, 810, 820, 830, 910, 920, 1010, 1020, 1030, 1110, and/or 1120) is in conductive contact with a portion of the wearer's body. Specifically, that heat from the wearer's body can warm the thermally conductive liquid within a thermal transfer bag (e.g., 110) or that heat carried by the thermally conductive liquid contained within a thermal transfer bag (e.g., 120) can warm a portion of the wearer's body. In some implementations, a clothing article may be configured to position a thermal transfer bag in direct contact with an exterior portion of the wearer's body, thereby placing the thermal transfer bag in heat exchange contact with a portion of the wearer's body. In some implementations, a clothing article may be configured to secure a thermal transfer bag between two or more layers of material (e.g., fabric) and thereby place the thermal transfer bag in heat exchange contact with a portion of the wearer's body.

The following are examples of how a thermal regulation system 100, 200, 300, 400, 500, 600, 700, 800, 900, 1000, 1100, or portions thereof, may be integrated into an article of clothing:

In some implementations, when a thermal regulation system 100, 200, 300, 400, 500, 600, 700, 800, 900, 1000, 1100 has been integrated into an article of clothing, each thermal transfer bag, tube, conduit, and/or other component of the thermal regulation system may be positioned between two or more layers of material (e.g., fabric).

In some implementations, when a thermal regulation system 100, 200, 300, 400, 500, 600, 700, 800, 900, 1000, 1100 has been integrated into an article of clothing, each thermal transfer bag, tube, conduit, and/or other component of the thermal regulation system may be secured to an interior side of the clothing article and thereby positioned in direct contact with an exterior portion of the wearer's body.

In some implementations, when a thermal regulation system 100, 200, 300, 400, 500, 600, 700, 800, 900, 1000, 1100 has been integrated into an article of clothing, each thermal transfer bag, tube, conduit, and/or other component of the thermal regulation system may be secured to an exterior side of the clothing article and thereby positioned in heat exchange contact with an exterior portion of the wearer's body.

In some implementations, when a thermal regulation system 100, 200, 300, 400, 500, 600, 700, 800, 900, 1000, 1100 has been integrated into an article of clothing, each thermal transfer bag may be individually held within a pouch of the clothing article. In some implementations, a pouch of a clothing article may be configured so that a thermal transfer bag can be removably secured therein.

In some implementations, when a thermal regulation system 100, 200, 300, 400, 500, 600, 700, 800, 900, 1000, 1100 has been integrated into an article of clothing, any tube(s) may be positioned within a sheath of the clothing article. In some implementations, when a thermal regulation system 100, 200, 300, 400, 500, 600, 700, 800, 900, 1000, 1100 has been integrated into an article of clothing, any tube(s) may not be positioned within a sheath of the clothing article.

The aforementioned examples of how a thermal regulation system, or portions thereof, could be integrated into an article of clothing are for example only and are not intended to limit the scope of the invention to the examples given. Instead, one of ordinary skill in the art, having the benefit of the present disclosure, would know how to integrate a thermal regulation system into an article of clothing.

In some implementations, a thermally conductive liquid other than water may be used with one or more implementations of the thermal regulation system 100, 200, 300, 400, 500, 600, 700, 800, 900, 1000, 1100 disclosed herein. In some implementations, a thermally conductive liquid having anti-freeze properties may be used with one or more implementations of the thermal regulation system 100, 200, 300, 400, 500, 600, 700, 800, 900, 1000, 1100. In some implementations, a thermally conductive gas (e.g., helium), or other fluid, may be used in lieu of a thermally conductive liquid.

In some implementations, no check valve (i.e., one-way valve) or other directional flow limiting device is used in conjunction with a thermal regulation system 100, 200, 300, 400, 500, 600, 700, 800, 900, 1000, 1100. In this way, the thermally conductive liquid may bi-directionally flow through the one or more tubes of a thermal regulation system 100, 200, 300, 400, 500, 600, 700, 800, 900, 1000, 1100.

In some implementations, a thermal regulation system 100, 200, 300, 400, 500, 600, 700, 800, 900, 1000, 1100 may be adapted and incorporated into any article of clothing and configured to transfer heat from a relatively warm region of the wearer's body to one or more other areas of the body. Accordingly, the thermal regulation systems 100, 200, 300, 400, 500, 600, 700, 800, 900, 1000, 1100 disclosed herein are not limited to use with a sock (e.g., 105, 205 605 905, 1005, 1105), a mitten (e.g., 305, 705, 805), a glove 405, or a shoe 505.

In some implementations, the thermal transfer bags of a thermal regulation system may each be secured directly to a portion of a wearer's body using, for example, an adhesive, elastic bands, etc. . . .

Reference throughout this specification to "an embodiment" or "implementation" or words of similar import means that a particular described feature, structure, or characteristic is included in at least one embodiment of the present invention. Thus, the phrase "in some implementations" or a phrase of similar import in various places throughout this specification does not necessarily refer to the same embodiment.

Many modifications and other embodiments of the inventions set forth herein will come to mind to one skilled in the art to which these inventions pertain having the benefit of the teachings presented in the foregoing descriptions and the associated drawings.

The described features, structures, or characteristics may be combined in any suitable manner in one or more embodiments. In the above description, numerous specific details are provided for a thorough understanding of embodiments of the invention. One skilled in the relevant art will recognize, however, that embodiments of the invention can be practiced without one or more of the specific details, or with other methods, components, materials, etc. In other instances, well-known structures, materials, or operations may not be shown or described in detail.

While operations are depicted in the drawings in a particular order, this should not be understood as requiring that such operations be performed in the particular order shown or in sequential order, or that all illustrated operations be performed, to achieve desirable results.

The invention claimed is:

1. A sock with an integrated thermal regulation system, the thermal regulation system comprising:

a first thermal transfer bag, the first thermal transfer bag is a container, made of flexible material, that is configured to contain a thermally conductive fluid therein and includes at least one baffle;

a second thermal transfer bag, the second thermal transfer bag is a container, made of flexible material, that is configured to contain a thermally conductive fluid therein and includes at least one baffle; and a volume of thermally conductive fluid, the volume of thermally conductive fluid is contained within the thermal regulation system;

wherein the thermal regulation system is configured so that the first thermal transfer bag and the second thermal transfer bag are in fluid communication;

wherein each baffle of the first thermal transfer bag and the second thermal transfer bag is positioned and configured to effect the distribution and flow of the thermally conductive fluid contained within the thermal regulation system;

wherein the sock comprises a foot portion configured to receive a foot of a wearer and a leg portion configured to receive at least a portion of a leg of the wearer, the sock positions the first thermal transfer bag in heat exchange contact with a portion of the leg of the wearer and the second thermal transfer bag in heat exchange contact with a first portion of the foot of the wearer;

wherein the first thermal transfer bag is configured so that a portion of the thermally conductive fluid contained therein can flow therefrom and into the second thermal transfer bag; and wherein the second thermal transfer bag is configured so that a movement of the foot of the wearer causes at least a portion of the thermally conductive fluid to flow therefrom and into the first thermal transfer bag.

2. The thermal regulation system of claim 1, wherein the first thermal transfer bag is comprised of two opposing sidewalls configured to form an interior compartment and each baffle of the first thermal transfer bag is formed by connecting a portion of the two opposing sidewalls together; and wherein the second thermal transfer bag is comprised of two opposing sidewalls configured to form an interior compartment and each baffle of the second thermal transfer bag is formed by connecting a portion of the two opposing sidewalls together.

3. The thermal regulation system of claim 2, further comprising a third thermal transfer bag that is in fluid communication with the first thermal transfer bag, the third thermal transfer bag is a container, made of flexible material, that is configured to contain a thermally conductive fluid therein and includes at least one baffle, each baffle is positioned and configured to effect the distribution and flow of the thermally conductive fluid contained within the thermal regulation system; wherein the sock is configured to position the third thermal transfer bag in heat exchange contact with a second portion of the foot of the wearer; and wherein the third thermal transfer bag is configured so that the movement of the foot of the wearer causes at least a portion of the thermally conductive fluid to flow therefrom and into the first thermal transfer bag.

4. The thermal regulation system of claim 3, wherein the third thermal transfer bag is comprised of two opposing sidewalls configured to form an interior compartment and each baffle of the third thermal transfer bag is formed by connecting a portion of the two opposing sidewalls together.

5. The thermal regulation system of claim 3, further comprising a conduit, the conduit extends between a lateral side of the second thermal transfer bag and a lateral side of the third thermal transfer bag, the conduit is configured to place the second thermal transfer bag into fluid communication with the third thermal transfer bag.

6. The thermal regulation system of claim 5, further comprising a spacer that is positioned within the conduit, the spacer is configured and positioned to preserve an opening extending through the conduit.

7. The thermal regulation system of claim 1, further comprising a conduit and a first tube; wherein the conduit extends from a lateral side of the second thermal transfer bag; and wherein the first tube extends from an end of the conduit positioned adjacent a dorsum side of the foot and is configured to place the first thermal transfer bag into fluid communication with the second thermal transfer bag.

8. The thermal regulation system of claim 7, further comprising a spacer that is positioned within the conduit, the spacer is configured and positioned to preserve an opening extending through the conduit.

* * * * *